United States Patent [19]

Signoretti

[11] Patent Number: 4,607,843

[45] Date of Patent: Aug. 26, 1986

[54] AUTOMATIC BOWLING POSITION INDICATOR

[76] Inventor: Edward J. Signoretti, 22 Veronica Ct., Smithtown, N.Y. 11787

[21] Appl. No.: 609,655

[22] Filed: May 14, 1984

[51] Int. Cl.[4] ..... A63D 5/04

[52] U.S. Cl. ..... 273/54 C; 273/54 E; 273/54 D; 434/249

[58] Field of Search ..... 273/37, 41, 46, 50, 273/52, 54 R, 54 C, 54 D, 54 E; 434/249

[56] References Cited

U.S. PATENT DOCUMENTS

| | | | |
|---|---|---|---|
| 3,250,535 | 5/1966 | Patterson et al. | 273/54 D |
| 3,284,928 | 11/1966 | Kelley | 434/249 |
| 4,302,010 | 11/1981 | Kaenel | 273/54 C |
| 4,339,128 | 7/1982 | Multner | 273/54 D |

*Primary Examiner*—Richard C. Pinkham

*Assistant Examiner*—Maryann Stoll Lastova

*Attorney, Agent, or Firm*—Morgan, Finnegan, Pine, Foley & Lee

[57] ABSTRACT

The Automatic Bowling Position Indicator (ABPI) of the present invention provides assistance to a bowler in order to achieve better scores by helping him to position himself on the approach. The positioning is dependent on variables such as whether the bowler is right or left handed, bowls a straight or hook ball, and the pins left standing. The invention assists the bowler directly in the area where the bowler makes his approach by providing a lighted indication of where to place his feet and by providing a lighted place over which the ball should pass. In addition, a group or team of bowlers is able to enter their bowling characteristics and have the present invention automatically advance and operate, thereby providing assistance throughout the game without further intervention.

7 Claims, 9 Drawing Figures

AUTOMATIC BOWLING POSITION INDICATOR

BACKGROUND OF THE INVENTION

1. Field of the Invention

The apparatus of the present invention relates generally to bowling equipment and more specifically relates to an automatic bowling position indicator for assisting a bowler to make spares and strikes.

2. Description of the Prior Art

Devices for assisting a bowler in the aim of his ball are well known in the prior art. U.S. Pat. Nos. 4,339,128, 3,841,633, and 3,460,832 each of which is assigned to AMF Incorporated, disclose bowling path indicators which provide the bowler with a visual indication of the optimum point of entry of a bowling ball into an array of standing pins. Typically, this visual indication is located directly above the standing pins and the bowler uses the visual indication to aim his ball.

Other devices known in the prior art include illuminated aiming spots disposed in the surface of the bowling lane in front of the foul line and the bowler uses them as aiming spots over which to roll his ball. Representative examples of these types of devices are disclosed in U.S. Pat. Nos. 3,250,535, and 3,120,956.

Bowling lanes typically have arrow indicators disposed on the lanes approximately fifteen feet forward of the foul line and dotted lines twelve to fifteen behind the foul lines. The arrows are to assist the bowler in the aiming of his ball and the dotted lines are for indicating approximately where the bowler should stand.

None of the above described devices, however, takes into consideration the individual bowling characteristics of a bowler or attempts to provide the bowler with a precise indication of his proper foot position. Accordingly, the above described devices are of limited value because they provide the bowler with imprecise information and do not take into consideration the bowler's individual bowling characteristics which effect the path that the ball takes.

Accordingly, there is a need for an automatic bowling position indicator that takes into consideration the individual bowling characteristics of his bowler and provides him with a precise visual indication of his proper foot position and a visual indication of the proper place over which his ball should pass in accordance with his individual throwing characteristics.

SUMMARY OF THE INVENTION

The apparatus of the present invention provides an automatic bowling position indicator that takes into consideration the individual bowling characteristics of a plurality of bowlers. The automatic bowling position indicator includes an automatic sequencer that is controlled by a microprocessor. The keyboard of the sequencer allows a plurality of bowlers to enter individual bowling characteristics, i.e., their bowling hand (right or left) or whether they bowl a straight or hook ball. A pin position indicator provides an indication of the standing pins and the microprocessor of the sequencer uses the stored bowling characteristics and pin indication to determine a precise foot position and ball position for each individual bowler when it is his turn to bowl. The foot position indication is provided by a first set of lights having two rows of semi-circular foot positions disposed behind the foul line of the bowling lane and the ball position over which the ball should pass is provided by a second set of arrow shaped lights disposed immediately in front of the foot position indicators. The apparatus of the present invention also provides the bowler with a visual indication of the proper point of entry of the ball into a standing array of pins.

DETAILED DESCRIPTION OF THE INVENTION

Figure 1:
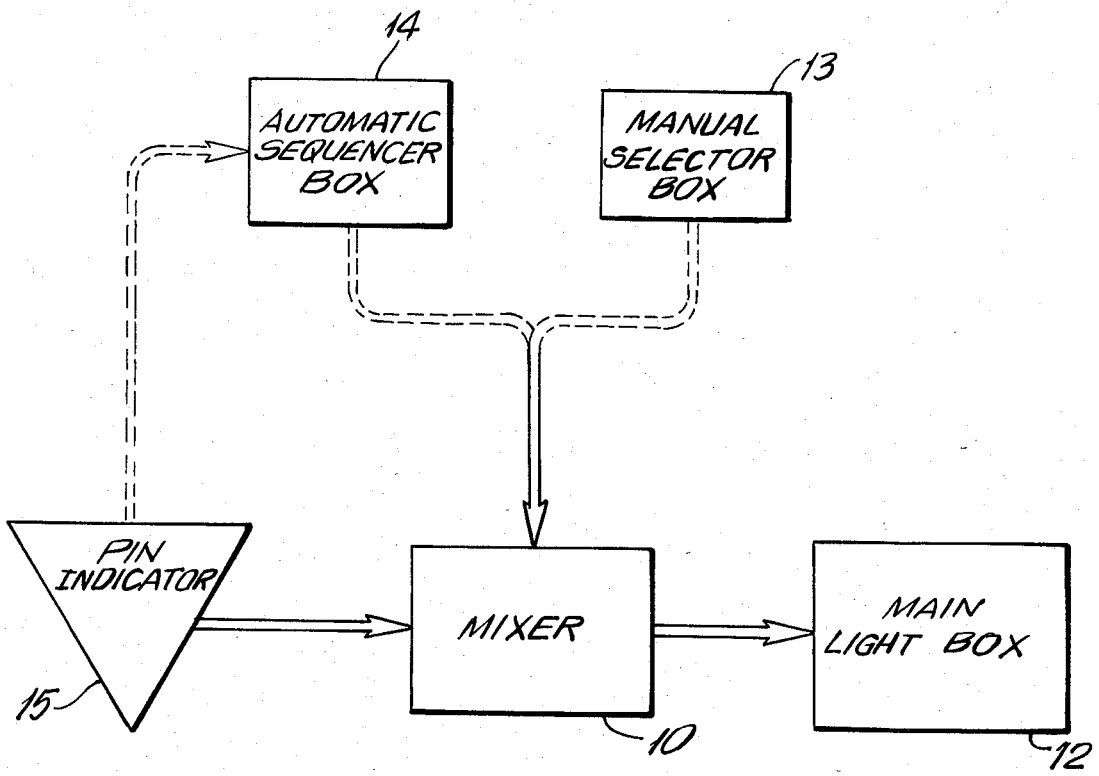
FIG. 1 is a general block disgram of hardware of the present invention.

A block diagram of the apparatus of the present invention is illustrated in FIG. 1. A mixer 10 receives "pin left standing" information from a conventional pin indicator I5. The mixer 10 receives bowler preference information from either a manually controlled selector box 13 or an automatic sequencer 14. This preference information indicates whether the bowler on the lane is right handed or left handed and whether he bowls a straight ball or a hook ball. The manual selector box 13 provides this information directly from a plurality of switches. The automatic sequencer 14 stores previously entered preference information or bowling characteristics and outputs the right/left and straight/hook data when the system sequences to the point when a particular bowler's turn to bowl comes up.

The mixer 10 analyzes the pins left standing information from the pin indicator I5 and bowler preference data either the automatic sequencer box 14 or the manual selector box 13. The mixer 10 is capable of providing lamp activation information to a main light box 12. The light box 12 preferably includes twenty five foot position lights and seven arrow light indicators. The foot position lights indicate starting points for the bowlers' feet and the arrow lights indicate the place to pass the ball over to properly throw the ball towards the pins left standing.

Figure 2A:
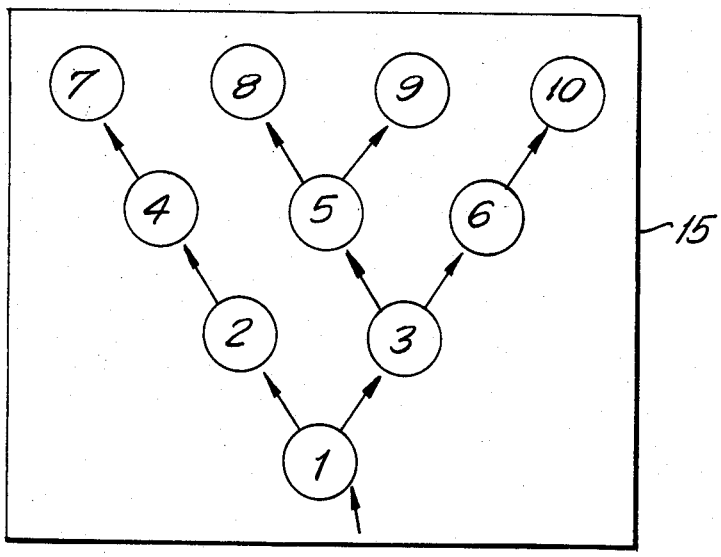
FIGS. 2A and 2B are illustrations of the sets of lights which provide a visual indications of foot position, ball position, and standing pin positions.
Figure 2B:
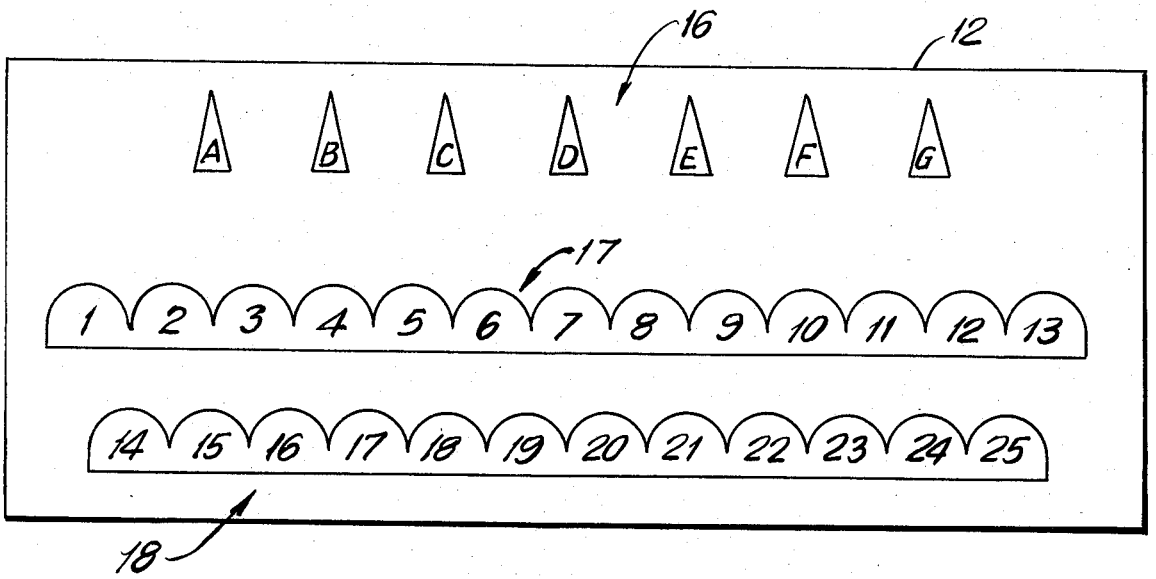

Referring now to FIGS. 2A and 2B; illustrations of various sets of lights associated with the present invention are provided. FIG. 2A illustrates a generally conventional pin indicator display 15 of the type disclosed in U.S. Pat. No. 3,460,832. The pin indicator 15 provides the bowler with a visual indication of the proper point of entry of his ball into a standing array of pins. The pin indicator 15 is typically disposed above the standing array of pins or it may be disposed in other locations such as the immediate vicinity of the bowler. FIG. 2B illustrates a plurality of illuminated arrows 16 labeled A–G which are disposed on the surface of the bowling lane. The illuminated arrows A–G are made from a light transmissive material and may be illuminated by LED's or other suitable low wattage illuminating devices. The illuminated arrows 16 provide a visual aiming point over which the bowling ball should pass. FIG. 2B also illustrates two rows of lights 17, 18 which provide the bowler with a visual indication for positioning his feet. The two rows of lights preferrably have semicircular shaped foot positions that are disposed in the bowling lane rearward of the foul line. The semicircular shaped foot position or lights 17, 18 provide the bowler with a foot position relative to the width of the lane. The bowler does not stand immediately over the semicircular foot position, but places his feet an appropriate distance from the foul line and in alignment with the semicircular foot position or lights 17, 18. The illumination for the two rows of lights 17, 18 may be provided by LED's or other suitable low wattage lighting devices.

Figure 3:
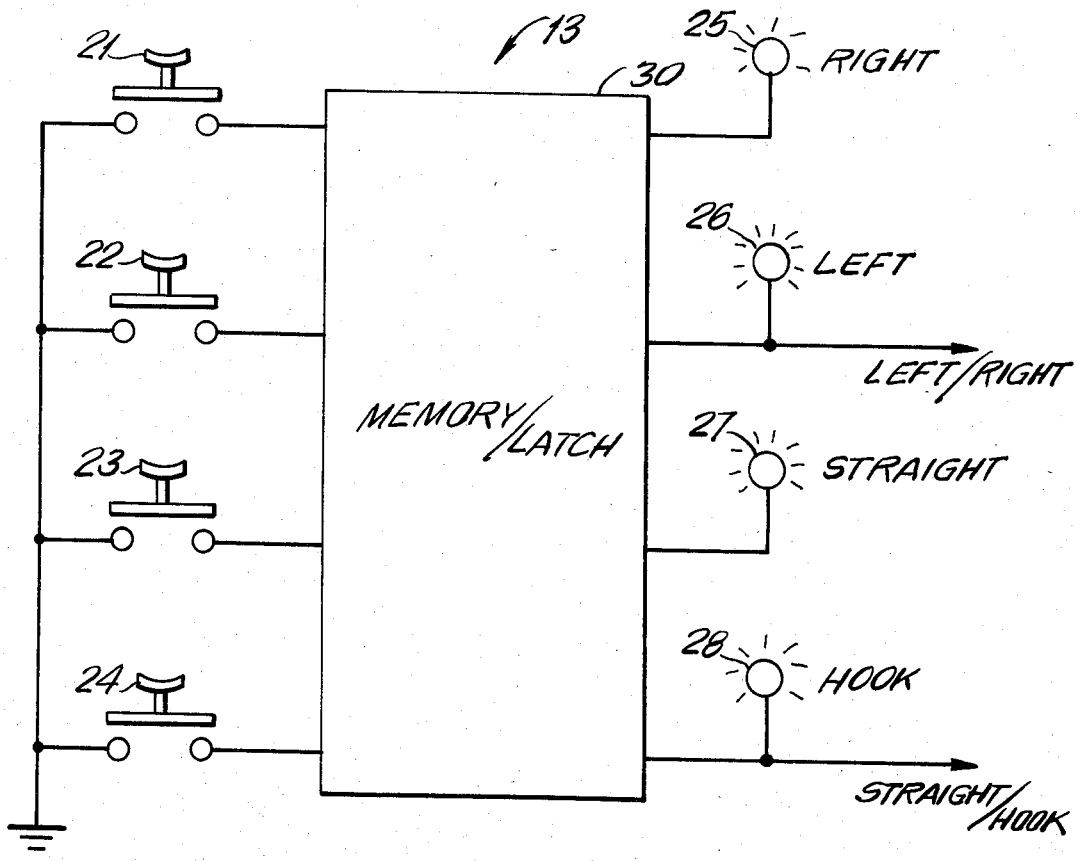
FIG. 3 is a schematic diagram of a manual selector which enables a bowler to enter his individual bowling characteristics.

A simplified diagram of the manual selector box 13 is shown in FIG. 3. The four switches 21–24 are used to select the four bowler preference posibilities, i.e., right handed, left handed, straight ball or hookd ball. Lights 25–28 are also provided to indicate to the operator which preference he has selected. The memory/latch 30 allows switches 21–24 to be of the push button type which enhances the human interface. Only one switch of switches 21–24 is used to choose a particular bowler preference characteristic. Each bowler chooses two characteristics by depressing either of switches 21,22 or switches 23,24 thereby providing four possible combinations, i.e., right/straight, right/hook, left/straight, or left/hook.

Figure 4:
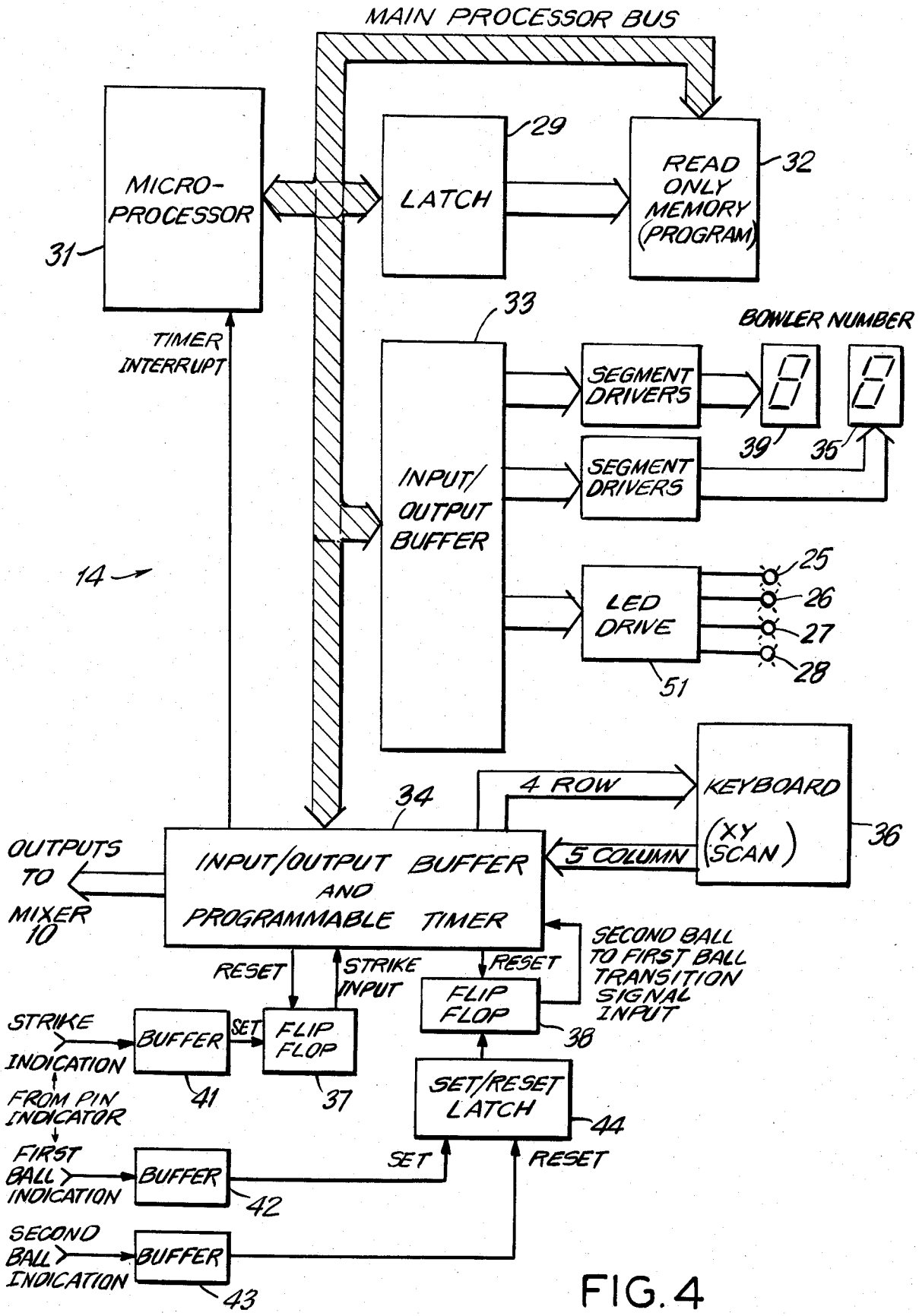
FIG. 4 is a schematic diagram of the automatic sequencer of the present invention of FIG. 3.

A diagram of the automatic sequencer 14 is shown in FIG. 4. The unit is controlled by a microprocessor 31 which sequences according to a program contained in a read only memory 32, that is coupled thereto by a latch 29. Two input/output (I/O) buffer storage elements 33, 34 provide the input/output interface to both the decimal LEDS 39, 35 and the keyboard 36. In addition the I/O elements 33, 34 control the mixer 10, the series of single LED indicators 25–28 via an LED Drive 51, and the interface to the Strike, First Ball, and Second Ball indication signals. The keyboard 36 shown in greater detail in FIG. 5 allows the bowler to enter bowler characteristic or preference information for each of up to ninty-nine bowlers. The decimal LEDS 39, 35 show which bowler is being attended to by the machine and the single LEDS 25–28 show the individual preference or bowler characteristics of that particular bowler. Frame advance signals are provided by either the Strike Input signal or the Second Ball to First Ball Transition signal. These latter two transition signals are provided from flip flops 37, 38 which are interrogated by the microprocessor 31. The microprocessor 31 resets the flip flop 37, 38 after interrogation. The control signals are buffered by buffers 41, 42, 43 prior to processing. The buffers 42, 43 are coupled to the flip flop 38 by a set/reset latch 44. The timer interrupt signal controls time sampling of the keyboard 36 to provide debouncing protection.

Figure 5:
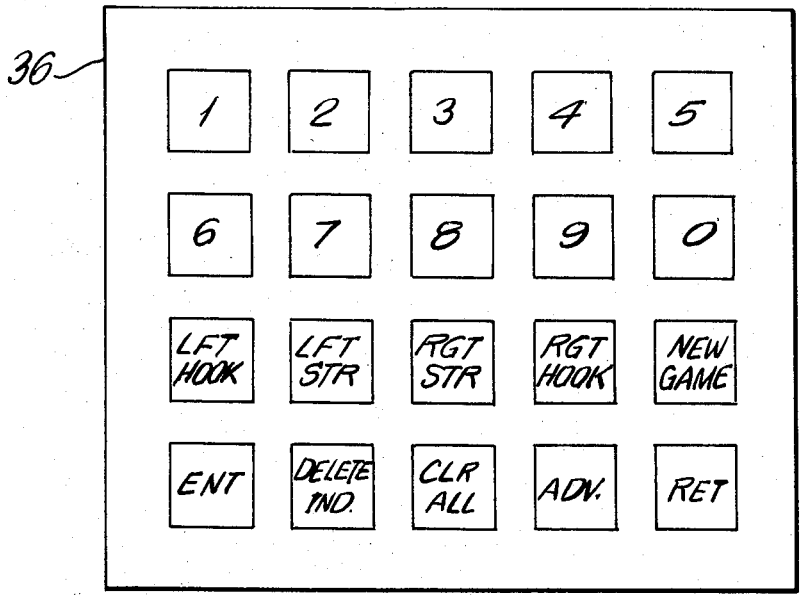
FIG. 5 is an illustration of the keyboard.

Referring now to FIG. 5, an illustration of the keyboard 36 is provided. The numeric keys numbered one through nine allow the bowler to enter his individual number which can be any two digit number for one through ninety-nine. The keys LFT HOOK, LFT STR, RGT STR, and RFT HOOK allow the bowler to enter his individual bowling characteristics. The key labeled NEW GAME allows the bowler to initiate a new game. The key labeled ENT is used to actually initiate any key entry action. The key labeled DELETE IND along with the numeric keys allows the dropping of a bowler in the sequence. The key labeled CLR ALL allows the memory in the device to be completely cleared. The key labeled ADV allows a bowler in sequence to be skipped over. The key labeled RET allows the sequence to go backwards by one bowler.

Figure 6:
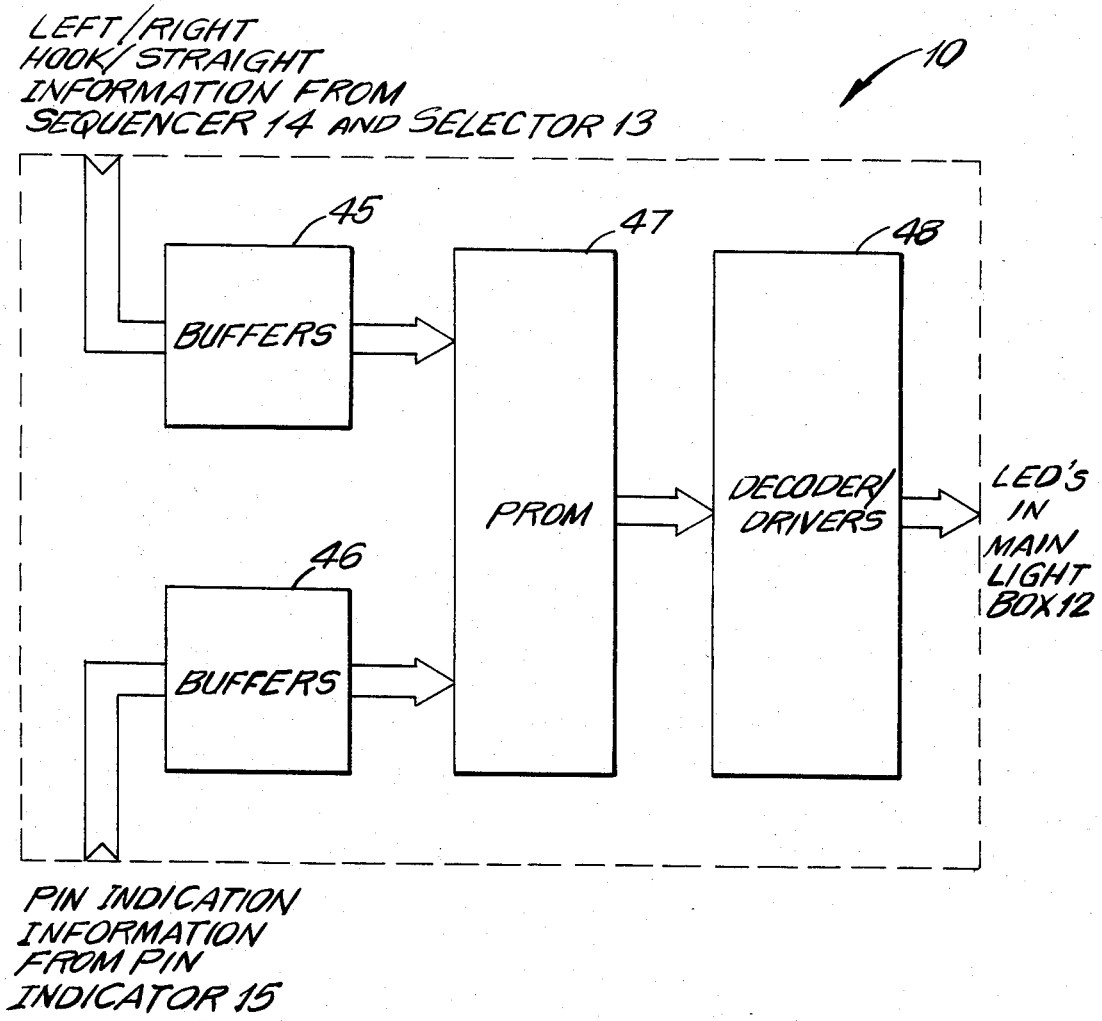
FIG. 6 is a block diagram of the mixer of the present invention.

A block diagram of the mixer 10 is shown in FIG. 6. The pin indication from pin indicator 15 and bowler preference data from the automatic sequencer box 14 and the manual selector box 13 are buffered by buffers 45, 46 prior to being processed in the mixer 10. The PROM 47 (Programmable Read Only Memory) contains the translation matrix from the input information to the LED (Approach Indicator) data. There are twelve inputs to the PROM 47. These twelve inputs include the ten pin indicator signals from pin indicator 15 and two signals representing the bowler preference characteristics from the sequencer 14 or the selector 13. Each of the 4096 combinations is programmed into a light pattern by the PROM 47. The eight PROM outputs are decoded and amplified by the decoder/drivers 48 so that the resulting output can turn on the LEDS in the main light box 12 directly. The light box 12 contains just wiring and actual lamps. The light box 12 is mounted in the lane approach in a way to allow the bowler to stand over the lighted foot position lamps 17, 18. The pattern in the box 12 is shown in FIG. 2. The mixer 10 drives both the twenty-five foot position lights 17, 18 and the seven arrow indicator lights 16.

The foot position lights 17, 18 and the arrow indicator lights 16 are lighted in accordance with information stored in the PROM 47. The information stored in the PROM 47 is determined empirically and the truth table appended hereto as an Appendix sets forth the various lights to be lighted in accordance with data provided by the pin indicators 15 and the bowling characteristics of an individual bowler.

The pins remaining in a standing array of pins generally determine the foot lights 17, 18 and arrow indicator lights 16 to be lighted. The individual bowling characteries (straight, hook, right or left) determine the exact lights 16, 17, 18 to be lighted. More specifically, either right hand or left hand bowling characteristic in combination with a particular array of standing pins determines a general light area which further defined by a hook or straight ball bowling characteristic.

EXAMPLE I

If the #1 pin is left standing either foot light #7 or #8 will light for a right handed bowler depending upon whether he bowls a straight or hook ball. If the right handed bowler bowls a straight ball the #8 light will light and if he bowls a hook ball the #7 light will light.

EXAMPLE II

If the #1 pin is left standing either light #6 or #7 will light for a left handed bowler depending upon whether he bowls a straight or a hook ball. If the left handed bowler bowls a straight ball the #6 light will light, and if the bowls a hook ball the #7 light will light.

The arrow lights 16 are generally controlled as a function of the pins left standing and whether the bowler is left or right handed. The influence of whether a bowler bowls a straight or hook ball is minimal on the lighting of the arrow light 16.

EXAMPLE III

If in the case of Example I where the #1 pin is left standing and the bowler is right handed, the arrow light "F" will light irrespective of whether the bowler bowls a straight or hook ball.

EXAMPLE IV

In in the case of Example II where the #1 pin is left standing and the bowler is left handed, the arrow light "B" will light irrespective of whether the bowler bowls a straight or hook ball.

Based upon the truth table appended hereto, the particular lights 16, 17, 18 to be lighted can be determined in accordance with the pins remaining in a standing array of pins and the individual bowling characteristics of a particular bowler.

Figure 7A:
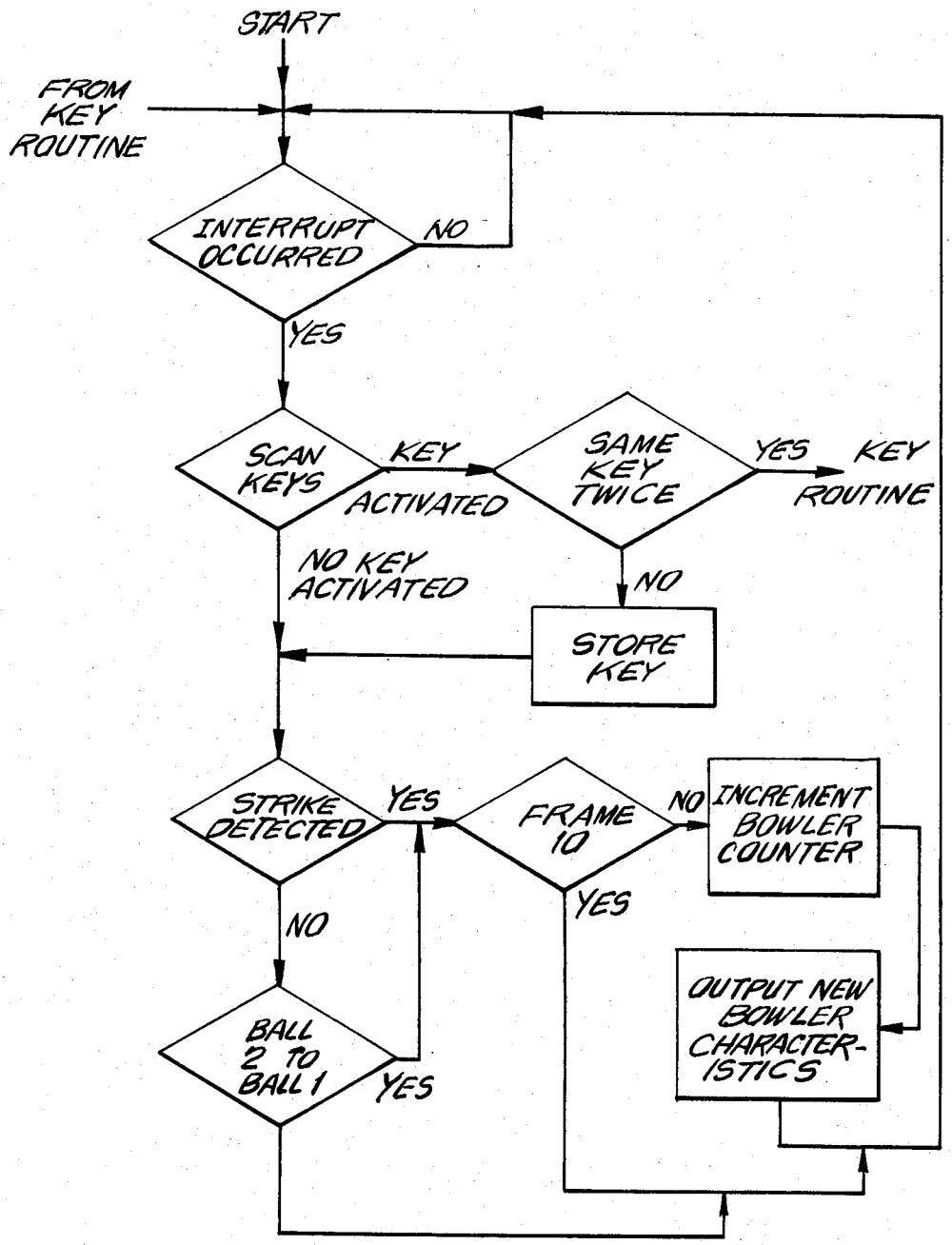
FIGS. 7A and 7B are flow diagrams of the software used in the control of the hardware of the present invention.
Figure 7B:
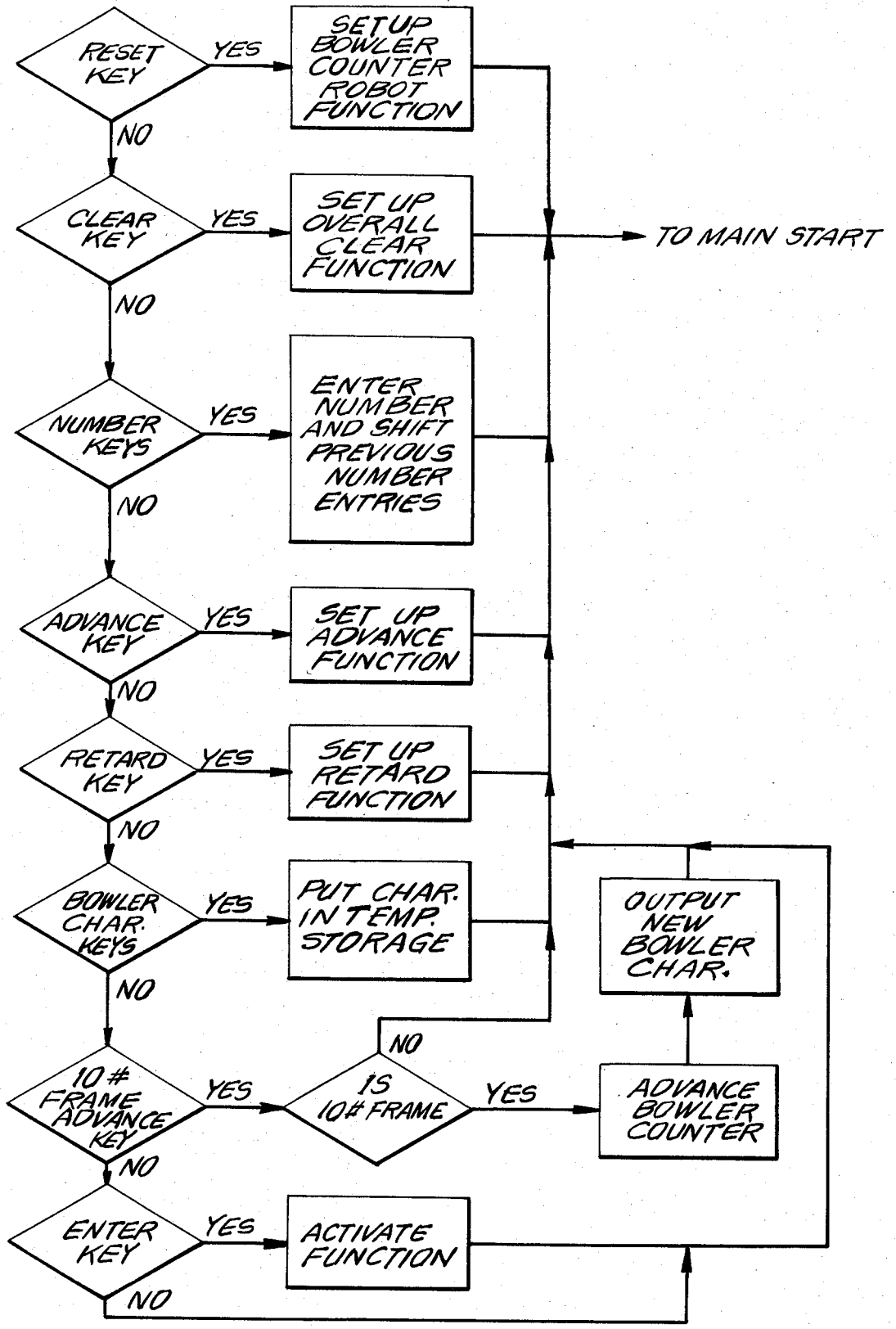

Referring now to FIGS. 7A and 7B flow diagrams of the software used in the control of the hardware of the present invention are provided. FIG. 7A is the main flow diagram illustrating overall system operation and FIG. 7B is a flow diagram for the key routines.

TRUTH TABLE

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 0 | 0000000000 | — | — | — | — | — | — | — | — |
| 1 | 0000000001 | 7 | 8 | 7 | 6 | F | F | B | B |
| 2 | 0000000010 | 8 | 9 | 11 | 11 | F | F | D/C | D |
| 3 | 0000000011 | 8 | 9 | 7 | 6 | F | F | D/C | D |
| 4 | 0000000100 | 3 | 3 | 6 | 5 | D/E | D | B | B |
| 5 | 0000000101 | 7 | 8 | 6 | 5 | F | F | B | B |
| 6 | 0000000110 | 20 | 21 | 19 | 18 | F | F | B | B |
| 7 | 0000000111 | 7 | 8 | 7 | 6 | F | F | B | B |
| 8 | 0000001000 | 9 | 10 | 12 | 12 | F | F | D/C | D |
| 9 | 0000001001 | 8 | 9 | 23 | 22 | F | F | C/D | D |
| 10 | 0000001010 | 8 | 9 | 23 | 22 | F | F | C/D | D |
| 11 | 0000001011 | 8 | 9 | 23 | 22 | F | F | C/D | D |
| 12 | 0000001100 | 15 | 15 | 17 | 16 | C/D | D | B | B |
| 13 | 0000001101 | 8 | 9 | 6 | 5 | F | F | B | B |
| 14 | 0000001110 | 20 | 21 | 19 | 18 | F | F | B | B |
| 15 | 0000001111 | 7 | 8 | 7 | 6 | F | F | B | B |
| 16 | 0000010000 | 7 | 8 | 7 | 6 | F | F | B | B |
| 17 | 0000010001 | 7 | 8 | 7 | 6 | F | F | B | B |
| 18 | 0000010010 | 8 | 9 | 6 | 5 | F | F | B | B |
| 19 | 0000010011 | 8 | 9 | 23 | 23 | F | F | D/C | D |
| 20 | 0000010100 | 3 | 3 | 6 | 5 | D/E | D | B | B |
| 21 | 0000010101 | 7 | 8 | 7 | 6 | F | F | B | B |
| 22 | 0000010110 | 20 | 21 | 19 | 18 | F | F | B | B |
| 23 | 0000010111 | 7 | 8 | 7 | 6 | F | F | B | B |
| 24 | 0000011000 | 21 | 22 | 23 | 23 | F | F | D/C | D |
| 25 | 0000011001 | 7 | 8 | 10 | 10 | F | F | D/C | D |
| 26 | 0000011010 | 8 | 9 | 6 | 5 | F | F | B | B |
| 27 | 0000011011 | 7 | 8 | 7 | 6 | F | F | B | B |
| 28 | 0000011100 | 3 | 3 | 5 | 4 | D/E | D | B | B |
| 29 | 0000011101 | 7 | 8 | 23 | 23 | F | F | D/C | D |
| 30 | 0000011110 | 20 | 21 | 19 | 18 | F | F | B | B |
| 31 | 0000011111 | 7 | 8 | 7 | 6 | F | F | B | B |
| 32 | 0000100000 | 3 | 3 | 5 | 4 | D/E | D | B | B |
| 33 | 0000100001 | 18 | 17 | 16 | 16 | B | B | D/C | D |
| 34 | 0000100010 | 22 | 23 | 18 | 17 | F | F | B | B |
| 35 | 0000100011 | 8 | 9 | 7 | 6 | F | F | B | B |
| 36 | 0000100100 | 3 | 3 | 6 | 5 | D/E | D | B | B |
| 37 | 0000100101 | 4 | 4 | 6 | 5 | D/E | D | B | B |
| 38 | 0000100110 | 20 | 21 | 19 | 18 | F | F | B | B |
| 39 | 0000100111 | 7 | 8 | 7 | 6 | F | F | B | B |
| 40 | 0000101000 | 11 | 12 | 4 | 3 | F | F | B | B |
| 41 | 0000101001 | 4 | 4 | 10 | 10 | D/E | D | D/C | D |
| 42 | 0000101010 | 22 | 23 | 24 | 24 | F | F | D/C | D |
| 43 | 0000101011 | 8 | 9 | 23 | 23 | F | F | D/C | D |
| 44 | 0000101100 | 15 | 15 | 17 | 16 | D/E | D | B | B |
| 45 | 0000101101 | 7 | 8 | 6 | 5 | F | F | B | B |
| 46 | 0000101110 | 15 | 15 | 24 | 24 | D/E | D | D/C | D |
| 47 | 0000101111 | 7 | 8 | 7 | 6 | F | F | B | B |
| 48 | 0000110000 | 16 | 16 | 18 | 17 | D/E | D | B | B |
| 49 | 0000110001 | 19 | 20 | 7 | 6 | F | F | B | B |
| 50 | 0000110010 | 9 | 10 | 11 | 11 | F | F | D/C | D |
| 51 | 0000110011 | 16 | 16 | 7 | 6 | D/E | D | B | B |
| 52 | 0000110100 | 3 | 3 | 6 | 5 | D/E | D | B | B |
| 53 | 0000110101 | 7 | 8 | 7 | 6 | F | F | B | B |
| 54 | 0000110110 | 20 | 21 | 19 | 18 | F | F | B | B |
| 55 | 0000110111 | 7 | 8 | 7 | 6 | F | F | B | B |
| 56 | 0000111000 | 4 | 4 | 10 | 10 | D/E | D | D/C | D |
| 57 | 0000111001 | 7 | 8 | 7 | 6 | F | F | B | B |
| 58 | 0000111010 | 22 | 23 | 24 | 24 | F | F | D/C | D |
| 59 | 0000111011 | 7 | 8 | 7 | 6 | F | F | B | B |
| 60 | 0000111100 | 15 | 15 | 17 | 16 | D/E | D | B | B |
| 61 | 0000111101 | 7 | 8 | 7 | 6 | F | F | B | B |
| 62 | 0000111110 | 20 | 21 | 19 | 18 | F | F | B | B |
| 63 | 0000111111 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 64 | 0 0 0 1 0 0 0 0 0 0 | 10 | 11 | 13 | 13 | F | F | D/C | D |
| 65 | 0 0 0 1 0 0 0 0 0 1 | 7 | 8 | 7 | 6 | F | F | B | B |
| 66 | 0 0 0 1 0 0 0 0 1 0 | 9 | 10 | 24 | 24 | F | F | D/C | D |
| 67 | 0 0 0 1 0 0 0 0 1 1 | 8 | 9 | 10 | 10 | F | F | D/C | D |
| 68 | 0 0 0 1 0 0 0 1 0 0 | 15 | 15 | 5 | 4 | D/E | D | B | B |
| 69 | 0 0 0 1 0 0 0 1 0 1 | 7 | 8 | 6 | 5 | F | F | B | B |
| 70 | 0 0 0 1 0 0 0 1 1 0 | 20 | 21 | 19 | 18 | F | F | B | B |
| 71 | 0 0 0 1 0 0 0 1 1 1 | 7 | 8 | 7 | 6 | F | F | B | B |
| 72 | 0 0 0 1 0 0 1 0 0 0 | 9 | 10 | 4 | 5 | F | F | B | B |
| 73 | 0 0 0 1 0 0 1 0 0 1 | 21 | 22 | 23 | 23 | F | F | D/C | D |
| 74 | 0 0 0 1 0 0 1 0 1 0 | 8 | 9 | 11 | 11 | F | F | D/C | D |
| 75 | 0 0 0 1 0 0 1 0 1 1 | 8 | 9 | 7 | 6 | F | F | B | B |
| 76 | 0 0 0 1 0 0 1 1 0 0 | 15 | 15 | 17 | 16 | D/E | D | B | B |
| 77 | 0 0 0 1 0 0 1 1 0 1 | 7 | 8 | 10 | 10 | F | F | D/C | D |
| 78 | 0 0 0 1 0 0 1 1 1 0 | 20 | 21 | 19 | 18 | F | F | B | B |
| 79 | 0 0 0 1 0 0 1 1 1 1 | 8 | 9 | 7 | 6 | F | F | B | B |
| 80 | 0 0 0 1 0 1 0 0 0 0 | 6 | 7 | 6 | 5 | F | F | B | B |
| 81 | 0 0 0 1 0 1 0 0 0 1 | 7 | 8 | 22 | 22 | F | F | D/C | D |
| 82 | 0 0 0 1 0 1 0 0 1 0 | 8 | 9 | 22 | 22 | F | F | D/C | D |
| 83 | 0 0 0 1 0 1 0 0 1 1 | 7 | 8 | 7 | 6 | F | F | B | B |
| 84 | 0 0 0 1 0 1 0 1 0 0 | 16 | 16 | 6 | 5 | D/E | D | B | B |
| 85 | 0 0 0 1 0 1 0 1 0 1 | 7 | 8 | 6 | 5 | F | F | B | B |
| 86 | 0 0 0 1 0 1 0 1 1 0 | 20 | 21 | 19 | 18 | F | F | B | B |
| 87 | 0 0 0 1 0 1 0 1 1 1 | 7 | 8 | 7 | 6 | F | F | B | B |
| 88 | 0 0 0 1 0 1 1 0 0 0 | 20 | 21 | 23 | 23 | F | F | D/C | D |
| 89 | 0 0 0 1 0 1 1 0 0 1 | 7 | 8 | 10 | 10 | F | F | D/C | D |
| 90 | 0 0 0 1 0 1 1 0 1 0 | 8 | 9 | 11 | 11 | F | F | D/C | D |
| 91 | 0 0 0 1 0 1 1 0 1 1 | 7 | 8 | 7 | 6 | F | F | B | B |
| 92 | 0 0 0 1 0 1 1 1 0 0 | 3 | 3 | 5 | 4 | D/E | D | B | B |
| 93 | 0 0 0 1 0 1 1 1 0 1 | 7 | 8 | 6 | 5 | F | F | B | B |
| 94 | 0 0 0 1 0 1 1 1 1 0 | 20 | 21 | 19 | 18 | F | F | B | B |
| 95 | 0 0 0 1 0 1 1 1 1 1 | 7 | 8 | 7 | 6 | F | F | B | B |
| 96 | 0 0 0 1 1 0 0 0 0 0 | 1 | 1 | 13 | 13 | D/E | D | D/C | D |
| 97 | 0 0 0 1 1 0 0 0 0 1 | 16 | 16 | 6 | 5 | D/E | D | B | B |
| 98 | 0 0 0 1 1 0 0 0 1 0 | 9 | 10 | 23 | 23 | F | F | D/C | D |
| 99 | 0 0 0 1 1 0 0 0 1 1 | 8 | 9 | 7 | 6 | F | F | B | B |
| 100 | 0 0 0 1 1 0 0 1 0 0 | 15 | 15 | 5 | 4 | D/E | D | B | B |
| 101 | 0 0 0 1 1 0 0 1 0 1 | 7 | 8 | 6 | 5 | F | F | B | B |
| 102 | 0 0 0 1 1 0 0 1 1 0 | 20 | 21 | 19 | 18 | F | F | B | B |
| 103 | 0 0 0 1 1 0 0 1 1 1 | 7 | 8 | 7 | 6 | F | F | B | B |
| 104 | 0 0 0 1 1 0 1 0 0 0 | 23 | 24 | 13 | 13 | F | F | D/C | D |
| 105 | 0 0 0 1 1 0 1 0 0 1 | 21 | 22 | 23 | 23 | F | F | D/C | D |
| 106 | 0 0 0 1 1 0 1 0 1 0 | 9 | 10 | 24 | 24 | F | F | D/C | D |
| 107 | 0 0 0 1 1 0 1 0 1 1 | 8 | 9 | 7 | 6 | F | F | B | B |
| 108 | 0 0 0 1 1 0 1 1 0 0 | 15 | 15 | 5 | 4 | D/E | D | B | B |
| 109 | 0 0 0 1 1 0 1 1 0 1 | 7 | 8 | 7 | 6 | F | F | B | B |
| 110 | 0 0 0 1 1 0 1 1 1 0 | 20 | 21 | 19 | 18 | F | F | B | B |
| 111 | 0 0 0 1 1 0 1 1 1 1 | 7 | 8 | 7 | 6 | F | F | B | B |
| 112 | 0 0 0 1 1 1 0 0 0 0 | 16 | 16 | 18 | 17 | D/E | D | B | B |
| 113 | 0 0 0 1 1 1 0 0 0 1 | 19 | 20 | 6 | 5 | F | F | B | B |
| 114 | 0 0 0 1 1 1 0 0 1 0 | 21 | 22 | 24 | 24 | F | F | D/C | D |
| 115 | 0 0 0 1 1 1 0 0 1 1 | 19 | 20 | 7 | 6 | F | F | B | B |
| 116 | 0 0 0 1 1 1 0 1 0 0 | 15 | 15 | 18 | 17 | D/E | D | B | B |
| 117 | 0 0 0 1 1 1 0 1 0 1 | 7 | 8 | 6 | 5 | F | F | B | B |
| 118 | 0 0 0 1 1 1 0 1 1 0 | 20 | 21 | 19 | 18 | F | F | B | B |
| 119 | 0 0 0 1 1 1 0 1 1 1 | 7 | 8 | 7 | 6 | F | F | B | B |
| 120 | 0 0 0 1 1 1 1 0 0 0 | 21 | 22 | 23 | 23 | F | F | D/C | D |
| 121 | 0 0 0 1 1 1 1 0 0 1 | 7 | 8 | 7 | 6 | F | F | B | B |
| 122 | 0 0 0 1 1 1 1 0 1 0 | 21 | 22 | 23 | 23 | F | F | D/C | D |
| 123 | 0 0 0 1 1 1 1 0 1 1 | 8 | 9 | 7 | 6 | F | F | B | B |
| 124 | 0 0 0 1 1 1 1 1 0 0 | 15 | 15 | 17 | 16 | D/E | D | B | B |
| 125 | 0 0 0 1 1 1 1 1 0 1 | 7 | 8 | 6 | 5 | F | F | B | B |
| 126 | 0 0 0 1 1 1 1 1 1 0 | 20 | 21 | 19 | 18 | F | F | B | B |
| 127 | 0 0 0 1 1 1 1 1 1 1 | 7 | 8 | 7 | 6 | F | F | B | B |
| 128 | 0 0 1 0 0 0 0 0 0 0 | 8 | 9 | 11 | 11 | F | F | D/C | D |
| 129 | 0 0 1 0 0 0 0 0 0 1 | 8 | 9 | 10 | 10 | F | F | D/C | D |
| 130 | 0 0 1 0 0 0 0 0 1 0 | 8 | 9 | 11 | 11 | F | F | D/C | D |
| 131 | 0 0 1 0 0 0 0 0 1 1 | 8 | 9 | 10 | 10 | F | F | D/C | D |
| 132 | 0 0 1 0 0 0 0 1 0 0 | 7 | 8 | 19 | 18 | F | F | B | B |
| 133 | 0 0 1 0 0 0 0 1 0 1 | 8 | 9 | 10 | 10 | F | F | D/C | D |
| 134 | 0 0 1 0 0 0 0 1 1 0 | 20 | 21 | 19 | 18 | F | F | B | B |
| 135 | 0 0 1 0 0 0 0 1 1 1 | 8 | 9 | 10 | 10 | F | F | D/C | D |
| 136 | 0 0 1 0 0 0 1 0 0 0 | 9 | 10 | 12 | 12 | F | F | D/C | D |
| 137 | 0 0 1 0 0 0 1 0 0 1 | 8 | 9 | 23 | 23 | F | F | D/C | D |
| 138 | 0 0 1 0 0 0 1 0 1 0 | 8 | 9 | 11 | 11 | F | F | D/C | D |
| 139 | 0 0 1 0 0 0 1 0 1 1 | 8 | 9 | 10 | 10 | F | F | D/C | D |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 140 | 0010001100 | 15 | 15 | 17 | 16 | D/E | D | B | B |
| 141 | 0010001101 | 8 | 9 | 10 | 10 | F | F | D/C | D |
| 142 | 0010001110 | 20 | 21 | 19 | 18 | F | F | B | B |
| 143 | 0010001111 | 8 | 9 | 10 | 10 | F | F | D/C | D |
| 144 | 0010010000 | 7 | 8 | 10 | 10 | F | F | D/C | D |
| 145 | 0010010001 | 7 | 8 | 7 | 6 | F | F | B | B |
| 146 | 0010010010 | 8 | 9 | 11 | 11 | F | F | D/C | D |
| 147 | 0010010011 | 7 | 8 | 7 | 6 | F | F | B | B |
| 148 | 0010010100 | 19 | 20 | 6 | 5 | F | F | B | B |
| 149 | 0010010101 | 7 | 8 | 7 | 6 | F | F | B | B |
| 150 | 0010010110 | 20 | 21 | 19 | 18 | F | F | B | B |
| 151 | 0010010111 | 7 | 8 | 7 | 6 | F | F | B | B |
| 152 | 0010011000 | 21 | 22 | 23 | 23 | F | F | D/C | D |
| 153 | 0010011001 | 8 | 9 | 10 | 10 | F | F | D/C | D |
| 154 | 0010011010 | 8 | 9 | 11 | 11 | F | F | D/C | D |
| 155 | 0010011011 | 7 | 8 | 7 | 6 | F | F | B | B |
| 156 | 0010011100 | 15 | 15 | 5 | 4 | D/E | D | B | B |
| 157 | 0010011101 | 7 | 8 | 10 | 10 | F | F | D/C | D |
| 158 | 0010011110 | 20 | 21 | 19 | 18 | F | F | B | B |
| 159 | 0010011111 | 7 | 8 | 7 | 6 | F | F | B | B |
| 160 | 0010100000 | 14 | 14 | 17 | 16 | D/E | D | B | B |
| 161 | 0010100001 | 8 | 9 | 7 | 6 | F | F | B | B |
| 162 | 0010100010 | 8 | 9 | 24 | 24 | F | F | D/C | D |
| 163 | 0010100011 | 8 | 9 | 10 | 10 | F | F | D/C | D |
| 164 | 0010100100 | 3 | 3 | 10 | 17 | D/E | D | B | B |
| 165 | 0010100101 | 8 | 9 | 7 | 6 | F | F | B | B |
| 166 | 0010100110 | 20 | 21 | 19 | 18 | F | F | B | B |
| 167 | 0010100111 | 8 | 9 | 7 | 6 | F | F | B | B |
| 168 | 0010101000 | 1 | 1 | 4 | 3 | D/E | D | B | B |
| 169 | 0010101001 | 21 | 22 | 10 | 10 | F | F | D/C | D |
| 170 | 0010101010 | 22 | 23 | 24 | 24 | F | F | D/C | D |
| 171 | 0010101011 | 8 | 9 | 10 | 10 | F | F | D/C | D |
| 172 | 0010101100 | 15 | 15 | 5 | 4 | D/E | D | B | B |
| 173 | 0010101101 | 8 | 9 | 23 | 23 | F | F | D/C | D |
| 174 | 0010101110 | 20 | 21 | 19 | 18 | F | F | B | B |
| 175 | 0010101111 | 8 | 9 | 10 | 10 | F | F | D/C | D |
| 176 | 0010110000 | 3 | 4 | 21 | 20 | D | D | B | B |
| 177 | 0010110001 | 20 | 21 | 7 | 6 | F | F | B | B |
| 178 | 0010110010 | 8 | 9 | 23 | 23 | F | F | D/C | D |
| 179 | 0010110011 | 20 | 21 | 7 | 6 | F | F | B | B |
| 180 | 0010110100 | 3 | 3 | 6 | 5 | D/E | D | B | B |
| 181 | 0010110101 | 7 | 8 | 7 | 6 | F | F | B | B |
| 182 | 0010110110 | 20 | 21 | 19 | 18 | F | F | B | B |
| 183 | 0010110111 | 7 | 8 | 7 | 6 | F | F | B | B |
| 184 | 0010111000 | 21 | 22 | 23 | 23 | F | F | D/C | D |
| 185 | 0010111001 | 8 | 9 | 20 | 19 | F | F | B | B |
| 186 | 0010111010 | 21 | 22 | 23 | 23 | F | F | D/C | D |
| 187 | 0010111011 | 8 | 9 | 7 | 6 | F | F | B | B |
| 188 | 0010111100 | 3 | 3 | 6 | 5 | D/E | D | B | B |
| 189 | 0010111101 | 7 | 8 | 6 | 5 | F | F | B | B |
| 190 | 0010111110 | 20 | 21 | 19 | 18 | F | F | B | B |
| 191 | 0010111111 | 7 | 8 | 7 | 6 | F | F | B | B |
| 192 | 0011000000 | 21 | 22 | 24 | 24 | F | F | D/C | D |
| 193 | 0011000001 | 4 | 4 | 19 | 18 | D/E | D | B | B |
| 194 | 0011000010 | 8 | 9 | 24 | 24 | F | F | D/C | D |
| 195 | 0011000011 | 8 | 9 | 6 | 5 | F | F | B | B |
| 196 | 0011000100 | 15 | 15 | 5 | 4 | D/E | D | B | B |
| 197 | 0011000101 | 7 | 8 | 6 | 5 | F | F | B | B |
| 198 | 0011000110 | 20 | 21 | 19 | 18 | F | F | B | B |
| 199 | 0011000111 | 8 | 9 | 10 | 10 | F | F | D/C | D |
| 200 | 0011001000 | 9 | 10 | 12 | 12 | F | F | D/C | D |
| 201 | 0011001001 | 21 | 22 | 6 | 5 | F | F | B | B |
| 202 | 0011001010 | 8 | 9 | 6 | 5 | F | F | D/C | D |
| 203 | 0011001011 | 8 | 9 | 10 | 10 | F | F | D/C | D |
| 204 | 0011001100 | 15 | 15 | 18 | 17 | D/E | D | B | B |
| 205 | 0011001101 | 8 | 9 | 23 | 23 | F | F | D/C | D |
| 206 | 0011001110 | 20 | 21 | 19 | 18 | F | F | B | B |
| 207 | 0011001111 | 8 | 9 | 10 | 10 | F | F | D/C | D |
| 208 | 0011010000 | 7 | 8 | 19 | 18 | F | F | B | B |
| 209 | 0011010001 | 7 | 8 | 6 | 5 | F | F | B | B |
| 210 | 0011010010 | 7 | 8 | 10 | 10 | F | F | D/C | D |
| 211 | 0011010011 | 7 | 8 | 7 | 6 | F | F | B | B |
| 212 | 0011010100 | 20 | 21 | 6 | 5 | F | F | B | B |
| 213 | 0011010101 | 7 | 8 | 6 | 5 | F | F | B | B |
| 214 | 0011010110 | 20 | 21 | 19 | 18 | F | F | B | B |
| 215 | 0011010111 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 216 | 0 0 1 1 0 1 1 0 0 0 | 21 | 22 | 23 | 23 | F | F | D/C | D |
| 217 | 0 0 1 1 0 1 1 0 0 1 | 7 | 8 | 10 | 10 | F | F | D/C | D |
| 218 | 0 0 1 1 0 1 1 0 1 0 | 8 | 9 | 11 | 11 | F | F | D/C | D |
| 219 | 0 0 1 1 0 1 1 0 1 1 | 7 | 8 | 7 | 6 | F | F | B | B |
| 220 | 0 0 1 1 0 1 1 1 0 0 | 7 | 8 | 6 | 5 | F | F | B | B |
| 221 | 0 0 1 1 0 1 1 1 0 1 | 7 | 8 | 9 | 9 | F | F | D/C | D |
| 222 | 0 0 1 1 0 1 1 1 1 0 | 20 | 21 | 19 | 18 | F | F | B | B |
| 223 | 0 0 1 1 0 1 1 1 1 1 | 7 | 8 | 7 | 6 | F | F | B | B |
| 224 | 0 0 1 1 1 0 0 0 0 0 | 1 | 1 | 16 | 15 | D/E | D | B | B |
| 225 | 0 0 1 1 1 0 0 0 0 1 | 8 | 9 | 7 | 6 | F | F | B | B |
| 226 | 0 0 1 1 1 0 0 0 1 0 | 22 | 23 | 24 | 24 | F | F | D/C | D |
| 227 | 0 0 1 1 1 0 0 0 1 1 | 8 | 9 | 10 | 10 | F | F | D/C | D |
| 228 | 0 0 1 1 1 0 0 1 0 0 | 3 | 3 | 5 | 4 | D/E | D | B | B |
| 229 | 0 0 1 1 1 0 0 1 0 1 | 7 | 8 | 18 | 17 | F | F | B | B |
| 230 | 0 0 1 1 1 0 0 1 1 0 | 20 | 21 | 19 | 18 | F | F | B | B |
| 231 | 0 0 1 1 1 0 0 1 1 1 | 8 | 9 | 10 | 10 | F | F | D/C | D |
| 232 | 0 0 1 1 1 0 1 0 0 0 | 9 | 10 | 12 | 12 | F | F | D/C | D |
| 233 | 0 0 1 1 1 0 1 0 0 1 | 4 | 4 | 6 | 5 | D/E | D | B | B |
| 234 | 0 0 1 1 1 0 1 0 1 0 | 9 | 10 | 24 | 24 | F | F | D/C | D |
| 235 | 0 0 1 1 1 0 1 0 1 1 | 8 | 9 | 10 | 10 | F | F | D/C | D |
| 236 | 0 0 1 1 1 0 1 1 0 0 | 15 | 15 | 5 | 4 | D/E | D | B | B |
| 237 | 0 0 1 1 1 0 1 1 0 1 | 4 | 4 | 6 | 5 | D/E | D | B | B |
| 238 | 0 0 1 1 1 0 1 1 1 0 | 20 | 21 | 19 | 18 | F | F | B | B |
| 239 | 0 0 1 1 1 0 1 1 1 1 | 8 | 9 | 10 | 10 | F | F | D/C | D |
| 240 | 0 0 1 1 1 1 0 0 0 0 | 16 | 16 | 18 | 17 | D/E | D | B | B |
| 241 | 0 0 1 1 1 1 0 0 0 1 | 7 | 8 | 7 | 6 | F | F | B | B |
| 242 | 0 0 1 1 1 1 0 0 1 0 | 8 | 9 | 23 | 23 | F | F | D/C | D |
| 243 | 0 0 1 1 1 1 0 0 1 1 | 8 | 9 | 7 | 8 | F | F | B | B |
| 244 | 0 0 1 1 1 1 0 1 0 0 | 3 | 3 | 6 | 5 | D/E | D | B | B |
| 245 | 0 0 1 1 1 1 0 1 0 1 | 7 | 8 | 6 | 5 | F | F | B | B |
| 246 | 0 0 1 1 1 1 0 1 1 0 | 20 | 21 | 19 | 18 | F | F | B | B |
| 247 | 0 0 1 1 1 1 0 1 1 1 | 7 | 8 | 6 | 5 | F | F | B | B |
| 248 | 0 0 1 1 1 1 1 0 0 0 | 21 | 22 | 23 | 23 | F | F | D/C | D |
| 249 | 0 0 1 1 1 1 1 0 0 1 | 7 | 8 | 10 | 10 | F | F | D/C | D |
| 250 | 0 0 1 1 1 1 1 0 1 0 | 8 | 9 | 11 | 11 | F | F | D/C | D |
| 251 | 0 0 1 1 1 1 1 0 1 1 | 8 | 9 | 7 | 6 | F | F | B | B |
| 252 | 0 0 1 1 1 1 1 1 0 0 | 3 | 3 | 6 | 5 | D/E | D | B | B |
| 253 | 0 0 1 1 1 1 1 1 0 1 | 7 | 8 | 10 | 10 | F | F | D/C | D |
| 254 | 0 0 1 1 1 1 1 1 1 0 | 20 | 21 | 19 | 18 | F | F | B | B |
| 255 | 0 0 1 1 1 1 1 1 1 1 | 7 | 8 | 7 | 6 | F | F | B | B |
| 256 | 0 1 0 0 0 0 0 0 0 0 | 3 | 3 | 6 | 5 | D/E | D | B | B |
| 257 | 0 1 0 0 0 0 0 0 0 1 | 4 | 4 | 6 | 5 | D/E | D | B | B |
| 258 | 0 1 0 0 0 0 0 0 1 0 | 20 | 21 | 7 | 6 | F | F | B | B |
| 259 | 0 1 0 0 0 0 0 0 1 1 | 4 | 4 | 6 | 5 | D/E | D | B | B |
| 260 | 0 1 0 0 0 0 0 1 0 0 | 3 | 3 | 6 | 5 | D/E | D | B | B |
| 261 | 0 1 0 0 0 0 0 1 0 1 | 4 | 4 | 6 | 5 | D/E | D | B | B |
| 262 | 0 1 0 0 0 0 0 1 1 0 | 20 | 21 | 19 | 18 | F | F | B | B |
| 263 | 0 1 0 0 0 0 0 1 1 1 | 4 | 4 | 6 | 5 | D/E | D | B | B |
| 264 | 0 1 0 0 0 0 1 0 0 0 | 22 | 23 | 25 | 25 | F | F | D/C | D |
| 265 | 0 1 0 0 0 0 1 0 0 1 | 4 | 4 | 6 | 5 | D/E | D | B | B |
| 266 | 0 1 0 0 0 0 1 0 1 0 | 21 | 22 | 11 | 11 | F | F | D/C | D |
| 267 | 0 1 0 0 0 0 1 0 1 1 | 7 | 8 | 6 | 5 | F | F | B | B |
| 268 | 0 1 0 0 0 0 1 1 0 0 | 15 | 15 | 6 | 5 | D/E | D | B | B |
| 269 | 0 1 0 0 0 0 1 1 0 1 | 4 | 4 | 6 | 5 | D/E | D | B | B |
| 270 | 0 1 0 0 0 0 1 1 1 0 | 20 | 21 | 19 | 18 | F | F | B | B |
| 271 | 0 1 0 0 0 0 1 1 1 1 | 7 | 8 | 6 | 5 | F | F | B | B |
| 272 | 0 1 0 0 0 1 0 0 0 0 | 7 | 8 | 7 | 6 | F | F | B | B |
| 273 | 0 1 0 0 0 1 0 0 0 1 | 7 | 8 | 7 | 6 | F | F | B | B |
| 274 | 0 1 0 0 0 1 0 0 1 0 | 8 | 9 | 11 | 11 | F | F | D/C | D |
| 275 | 0 1 0 0 0 1 0 0 1 1 | 7 | 8 | 7 | 6 | F | F | B | B |
| 276 | 0 1 0 0 0 1 0 1 0 0 | 3 | 3 | 6 | 5 | D/E | D | B | B |
| 277 | 0 1 0 0 0 1 0 1 0 1 | 7 | 8 | 7 | 6 | F | F | B | B |
| 278 | 0 1 0 0 0 1 0 1 1 0 | 20 | 21 | 19 | 18 | F | F | B | B |
| 279 | 0 1 0 0 0 1 0 1 1 1 | 7 | 8 | 7 | 6 | F | F | B | B |
| 280 | 0 1 0 0 0 1 1 0 0 0 | 18 | 19 | 11 | 12 | F | F | D | D |
| 281 | 0 1 0 0 0 1 1 0 0 1 | 7 | 8 | 19 | 18 | F | F | B | B |
| 282 | 0 1 0 0 0 1 1 0 1 0 | 8 | 9 | 11 | 11 | F | F | D/C | D |
| 283 | 0 1 0 0 0 1 1 0 1 1 | 7 | 8 | 7 | 6 | F | F | B | B |
| 284 | 0 1 0 0 0 1 1 1 0 0 | 16 | 16 | 6 | 5 | D/E | D | B | B |
| 285 | 0 1 0 0 0 1 1 1 0 1 | 7 | 8 | 19 | 18 | F | F | B | B |
| 286 | 0 1 0 0 0 1 1 1 1 0 | 20 | 21 | 19 | 18 | F | F | B | B |
| 287 | 0 1 0 0 0 1 1 1 1 1 | 7 | 8 | 7 | 6 | F | F | B | B |
| 288 | 0 1 0 0 1 0 0 0 0 0 | 3 | 3 | 5 | 4 | D/E | D | B | B |
| 289 | 0 1 0 0 1 0 0 0 0 1 | 16 | 16 | 6 | 5 | D/E | D | B | B |
| 290 | 0 1 0 0 1 0 0 0 1 0 | 22 | 23 | 24 | 24 | F | F | D/C | D |
| 291 | 0 1 0 0 1 0 0 0 1 1 | 4 | 4 | 6 | 5 | D/E | D | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 292 | 0 1 0 0 1 0 0 1 0 0 | 3 | 3 | 6 | 5 | D/E | D | B | B |
| 293 | 0 1 0 0 1 0 0 1 0 1 | 4 | 4 | 6 | 5 | D/E | D | B | B |
| 294 | 0 1 0 0 1 0 0 1 1 0 | 20 | 21 | 19 | 18 | F | F | B | B |
| 295 | 0 1 0 0 1 0 0 1 1 1 | 4 | 4 | 6 | 5 | D/E | D | B | B |
| 296 | 0 1 0 0 1 0 1 0 0 0 | 10 | 11 | 13 | 13 | F | F | D/C | D |
| 297 | 0 1 0 0 1 0 1 0 0 1 | 4 | 4 | 18 | 17 | D/E | D | B | B |
| 298 | 0 1 0 0 1 0 1 0 1 0 | 9 | 10 | 24 | 24 | F | F | D/C | D |
| 299 | 0 1 0 0 1 0 1 0 1 1 | 3 | 3 | 6 | 5 | D/E | D | B | B |
| 300 | 0 1 0 0 1 0 1 1 0 0 | 15 | 15 | 17 | 16 | D/E | D | B | B |
| 301 | 0 1 0 0 1 0 1 1 0 1 | 3 | 3 | 6 | 5 | D/E | D | B | B |
| 302 | 0 1 0 0 1 0 1 1 1 0 | 20 | 21 | 19 | 18 | F | F | B | B |
| 303 | 0 1 0 0 1 0 1 1 1 1 | 7 | 8 | 6 | 5 | F | F | B | B |
| 304 | 0 1 0 0 1 1 0 0 0 0 | 16 | 16 | 18 | 17 | D/E | D | B | B |
| 305 | 0 1 0 0 1 1 0 0 0 1 | 4 | 4 | 6 | 5 | D/E | D | B | B |
| 306 | 0 1 0 0 1 1 0 0 1 0 | 3 | 3 | 6 | 5 | D/E | D | B | B |
| 307 | 0 1 0 0 1 1 0 0 1 1 | 7 | 8 | 7 | 6 | F | F | B | B |
| 308 | 0 1 0 0 1 1 0 1 0 0 | 3 | 3 | 6 | 5 | D/E | D | B | B |
| 309 | 0 1 0 0 1 1 0 1 0 1 | 7 | 8 | 7 | 6 | F | F | B | B |
| 310 | 0 1 0 0 1 1 0 1 1 0 | 20 | 21 | 19 | 18 | F | F | B | B |
| 311 | 0 1 0 0 1 1 0 1 1 1 | 7 | 8 | 7 | 6 | F | F | B | B |
| 312 | 0 1 0 0 1 1 1 0 0 0 | 16 | 16 | 19 | 18 | D/E | D | B | B |
| 313 | 0 1 0 0 1 1 1 0 0 1 | 19 | 20 | 6 | 5 | F | F | B | B |
| 314 | 0 1 0 0 1 1 1 0 1 0 | 16 | 16 | 18 | 17 | D/E | D | B | B |
| 315 | 0 1 0 0 1 1 1 0 1 1 | 7 | 8 | 6 | 5 | F | F | B | B |
| 316 | 0 1 0 0 1 1 1 1 0 0 | 8 | 9 | 11 | 11 | F | F | D/C | D |
| 317 | 0 1 0 0 1 1 1 1 0 1 | 8 | 9 | 7 | 6 | F | F | B | B |
| 318 | 0 1 0 0 1 1 1 1 1 0 | 20 | 21 | 19 | 18 | F | F | B | B |
| 319 | 0 1 0 0 1 1 1 1 1 1 | 7 | 8 | 7 | 6 | F | F | B | B |
| 320 | 0 1 0 1 0 0 0 0 0 0 | 15 | 15 | 18 | 17 | D/E | D | B | B |
| 321 | 0 1 0 1 0 0 0 0 0 1 | 7 | 8 | 6 | 5 | F | F | B | B |
| 322 | 0 1 0 1 0 0 0 0 1 0 | 9 | 10 | 7 | 6 | F | F | B | B |
| 323 | 0 1 0 1 0 0 0 0 1 1 | 7 | 8 | 19 | 18 | F | F | B | B |
| 324 | 0 1 0 1 0 0 0 1 0 0 | 15 | 15 | 6 | 5 | D/E | D | B | B |
| 325 | 0 1 0 1 0 0 0 1 0 1 | 7 | 8 | 6 | 5 | F | F | B | B |
| 326 | 0 1 0 1 0 0 0 1 1 0 | 20 | 21 | 19 | 18 | F | F | B | B |
| 327 | 0 1 0 1 0 0 0 1 1 1 | 7 | 8 | 6 | 5 | F | F | B | B |
| 328 | 0 1 0 1 0 0 1 0 0 0 | 23 | 24 | 13 | 13 | F | F | D/C | D |
| 329 | 0 1 0 1 0 0 1 0 0 1 | 7 | 8 | 6 | 5 | F | F | B | B |
| 330 | 0 1 0 1 0 0 1 0 1 0 | 9 | 10 | 11 | 11 | F | F | D/C | D |
| 331 | 0 1 0 1 0 0 1 0 1 1 | 7 | 8 | 6 | 5 | F | F | B | B |
| 332 | 0 1 0 1 0 0 1 1 0 0 | 3 | 3 | 12 | 12 | D/E | D | E | E |
| 333 | 0 1 0 1 0 0 1 1 0 1 | 16 | 16 | 6 | 5 | D/E | D | B | B |
| 334 | 0 1 0 1 0 0 1 1 1 0 | 20 | 21 | 19 | 18 | F | F | B | B |
| 335 | 0 1 0 1 0 0 1 1 1 1 | 7 | 8 | 6 | 5 | F | F | B | B |
| 336 | 0 1 0 1 0 1 0 0 0 0 | 6 | 7 | 6 | 5 | F | F | B | B |
| 337 | 0 1 0 1 0 1 0 0 0 1 | 7 | 8 | 22 | 21 | F | F | D/C | D |
| 338 | 0 1 0 1 0 1 0 0 1 0 | 8 | 9 | 11 | 11 | F | F | D/C | D |
| 339 | 0 1 0 1 0 1 0 0 1 1 | 7 | 8 | 7 | 6 | F | F | B | B |
| 340 | 0 1 0 1 0 1 0 1 0 0 | 3 | 3 | 18 | 17 | D/E | D | B | B |
| 341 | 0 1 0 1 0 1 0 1 0 1 | 7 | 8 | 6 | 5 | F | F | B | B |
| 342 | 0 1 0 1 0 1 0 1 1 0 | 20 | 21 | 19 | 18 | F | F | B | B |
| 343 | 0 1 0 1 0 1 0 1 1 1 | 7 | 8 | 7 | 6 | F | F | B | B |
| 344 | 0 1 0 1 0 1 0 0 0 0 | 21 | 22 | 23 | 23 | F | F | D/C | D |
| 345 | 0 1 0 1 0 1 1 0 0 1 | 7 | 8 | 6 | 5 | F | F | B | B |
| 346 | 0 1 0 1 0 1 1 0 1 0 | 8 | 9 | 11 | 11 | F | F | D/C | D |
| 347 | 0 1 0 1 0 1 1 0 1 1 | 7 | 8 | 7 | 6 | F | F | B | B |
| 348 | 0 1 0 1 0 1 1 1 0 0 | 3 | 3 | 18 | 17 | D/E | D | B | B |
| 349 | 0 1 0 1 0 1 1 1 0 1 | 7 | 8 | 6 | 5 | F | F | B | B |
| 350 | 0 1 0 1 0 1 1 1 1 0 | 20 | 21 | 19 | 18 | F | F | B | B |
| 351 | 0 1 0 1 0 1 1 1 1 1 | 7 | 8 | 7 | 6 | F | F | B | B |
| 352 | 0 1 0 1 1 0 0 0 0 0 | 14 | 14 | 4 | 3 | D/E | D | B | B |
| 353 | 0 1 0 1 1 0 0 0 0 1 | 4 | 4 | 6 | 5 | D/E | D | B | B |
| 354 | 0 1 0 1 1 0 0 0 1 0 | 22 | 23 | 24 | 24 | F | F | D/C | D |
| 355 | 0 1 0 1 1 0 0 0 1 1 | 8 | 9 | 7 | 6 | F | F | B | B |
| 356 | 0 1 0 1 1 0 0 1 0 0 | 15 | 15 | 5 | 4 | D/E | D | B | B |
| 357 | 0 1 0 1 1 0 0 1 0 1 | 7 | 8 | 6 | 5 | F | F | B | B |
| 358 | 0 1 0 1 1 0 0 1 1 0 | 20 | 21 | 19 | 18 | F | F | B | B |
| 359 | 0 1 0 1 1 0 0 1 1 1 | 9 | 8 | 6 | 5 | F | F | B | B |
| 360 | 0 1 0 1 1 0 1 0 0 0 | 23 | 24 | 25 | 25 | F | F | D/C | D |
| 361 | 0 1 0 1 1 0 1 0 0 1 | 16 | 16 | 6 | 5 | D/E | D | D | D |
| 362 | 0 1 0 1 1 0 1 0 1 0 | 9 | 10 | 24 | 24 | F | F | D/C | D |
| 363 | 0 1 0 1 1 0 1 0 1 1 | 8 | 9 | 23 | 23 | F | F | D/C | D |
| 364 | 0 1 0 1 1 0 1 1 0 0 | 15 | 15 | 17 | 16 | D/E | D | B | B |
| 365 | 0 1 0 1 1 0 1 1 0 1 | 7 | 8 | 6 | 5 | F | F | B | B |
| 366 | 0 1 0 1 1 0 1 1 1 0 | 20 | 21 | 19 | 18 | F | F | B | B |
| 367 | 0 1 0 1 1 0 1 1 1 1 | 7 | 8 | 6 | 5 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 368 | 0 1 0 1 1 1 0 0 0 0 | 16 | 16 | 18 | 17 | D/E | D | B | B |
| 369 | 0 1 0 1 1 1 0 0 0 1 | 4 | 4 | 6 | 5 | D/E | D | B | B |
| 370 | 0 1 0 1 1 1 0 0 1 0 | 9 | 10 | 24 | 24 | F | F | D/C | D |
| 371 | 0 1 0 1 1 1 0 0 1 1 | 8 | 9 | 7 | 6 | F | F | B | B |
| 372 | 0 1 0 1 1 1 0 1 0 0 | 3 | 3 | 6 | 5 | D/E | D | B | B |
| 373 | 0 1 0 1 1 1 0 1 0 1 | 7 | 8 | 6 | 5 | F | F | B | B |
| 374 | 0 1 0 1 1 1 0 1 1 0 | 20 | 21 | 19 | 18 | F | F | B | B |
| 375 | 0 1 0 1 1 1 0 1 1 1 | 7 | 8 | 7 | 6 | F | F | B | B |
| 376 | 0 1 0 1 1 1 1 0 0 0 | 16 | 16 | 18 | 17 | D/E | D | B | B |
| 377 | 0 1 0 1 1 1 1 0 0 1 | 7 | 8 | 6 | 5 | F | F | B | B |
| 378 | 0 1 0 1 1 1 1 0 1 0 | 9 | 10 | 23 | 23 | F | F | D/C | D |
| 379 | 0 1 0 1 1 1 1 0 1 1 | 8 | 9 | 7 | 6 | F | F | B | B |
| 380 | 0 1 0 1 1 1 1 1 0 0 | 3 | 3 | 5 | 4 | D/E | D | B | B |
| 381 | 0 1 0 1 1 1 1 1 0 1 | 7 | 8 | 6 | 5 | F | F | B | B |
| 382 | 0 1 0 1 1 1 1 1 1 0 | 20 | 21 | 19 | 18 | F | F | B | B |
| 383 | 0 1 0 1 1 1 1 1 1 1 | 7 | 8 | 7 | 6 | F | F | B | B |
| 384 | 0 1 1 0 0 0 0 0 0 0 | 7 | 8 | 7 | 6 | F | F | B | B |
| 385 | 0 1 1 0 0 0 0 0 0 1 | 19 | 18 | 20 | 21 | F | F | B | B |
| 386 | 0 1 1 0 0 0 0 0 1 0 | 5 | 5 | 7 | 6 | D/E | D | B | B |
| 387 | 0 1 1 0 0 0 0 0 1 1 | 5 | 8 | 7 | 6 | F | F | B | B |
| 388 | 0 1 1 0 0 0 0 1 0 0 | 7 | 8 | 9 | 9 | F | F | D/C | D |
| 389 | 0 1 1 0 0 0 0 1 0 1 | 7 | 8 | 7 | 6 | F | F | B | B |
| 390 | 0 1 1 0 0 0 0 1 1 0 | 20 | 21 | 19 | 18 | F | F | B | B |
| 391 | 0 1 1 0 0 0 0 1 1 1 | 7 | 8 | 7 | 6 | F | F | B | B |
| 392 | 0 1 1 0 0 0 1 0 0 0 | 22 | 23 | 12 | 12 | F | F | D/C | D |
| 393 | 0 1 1 0 0 0 1 0 0 1 | 7 | 8 | 6 | 5 | F | F | B | B |
| 394 | 0 1 1 0 0 0 1 0 1 0 | 9 | 10 | 11 | 11 | F | F | D/C | D |
| 395 | 0 1 1 0 0 0 1 0 1 1 | 7 | 8 | 6 | 5 | F | F | B | B |
| 396 | 0 1 1 0 0 0 1 1 0 0 | 7 | 8 | 9 | 9 | F | F | D/C | D |
| 397 | 0 1 1 0 0 0 1 1 0 1 | 7 | 8 | 6 | 5 | F | F | B | B |
| 398 | 0 1 1 0 0 0 1 1 1 0 | 20 | 21 | 19 | 18 | F | F | B | B |
| 399 | 0 1 1 0 0 0 1 1 1 1 | 7 | 8 | 7 | 6 | F | F | B | B |
| 400 | 0 1 1 0 0 1 0 0 0 0 | 7 | 8 | 7 | 6 | F | F | B | B |
| 401 | 0 1 1 0 0 1 0 0 0 1 | 7 | 8 | 7 | 6 | F | F | B | B |
| 402 | 0 1 1 0 0 1 0 0 1 0 | 8 | 9 | 7 | 6 | F | F | B | B |
| 403 | 0 1 1 0 0 1 0 0 1 1 | 7 | 8 | 7 | 6 | F | F | B | B |
| 404 | 0 1 1 0 0 1 0 1 0 0 | 7 | 8 | 6 | 5 | F | F | B | B |
| 405 | 0 1 1 0 0 1 0 1 0 1 | 7 | 8 | 7 | 6 | F | F | B | B |
| 406 | 0 1 1 0 0 1 0 1 1 0 | 20 | 21 | 19 | 18 | F | F | B | B |
| 407 | 0 1 1 0 0 1 0 1 1 1 | 7 | 8 | 7 | 6 | F | F | B | B |
| 408 | 0 1 1 0 0 1 1 0 0 0 | 21 | 22 | 23 | 23 | F | F | D/C | D |
| 409 | 0 1 1 0 0 1 1 0 0 1 | 7 | 8 | 9 | 9 | F | F | D/C | D |
| 410 | 0 1 1 0 0 1 1 0 1 0 | 8 | 9 | 11 | 11 | F | F | D/C | D |
| 411 | 0 1 1 0 0 1 1 0 1 1 | 7 | 8 | 7 | 6 | F | F | B | B |
| 412 | 0 1 1 0 0 1 1 1 0 0 | 4 | 4 | 9 | 9 | D/E | D | D/C | D |
| 413 | 0 1 1 0 0 1 1 1 0 1 | 7 | 8 | 6 | 5 | F | F | B | B |
| 414 | 0 1 1 0 0 1 1 1 1 0 | 20 | 21 | 19 | 18 | F | F | B | B |
| 415 | 0 1 1 0 0 1 1 1 1 1 | 7 | 8 | 7 | 6 | F | F | B | B |
| 416 | 0 1 1 0 1 0 0 0 0 0 | 2 | 2 | 17 | 16 | D/E | D | B | B |
| 417 | 0 1 1 0 1 0 0 0 0 1 | 8 | 9 | 7 | 6 | F | F | B | B |
| 418 | 0 1 1 0 1 0 0 0 1 0 | 5 | 5 | 7 | 6 | D/E | D | B | B |
| 419 | 0 1 1 0 1 0 0 0 1 1 | 8 | 9 | 7 | 6 | F | F | B | B |
| 420 | 0 1 1 0 1 0 0 1 0 0 | 3 | 3 | 5 | 4 | D/E | D | B | B |
| 421 | 0 1 1 0 1 0 0 1 0 1 | 8 | 9 | 7 | 6 | F | F | B | B |
| 422 | 0 1 1 0 1 0 0 1 1 0 | 20 | 21 | 19 | 18 | F | F | B | B |
| 423 | 0 1 1 0 1 0 0 1 1 1 | 7 | 8 | 7 | 6 | F | F | B | B |
| 424 | 0 1 1 0 1 0 1 0 0 0 | 9 | 10 | 6 | 5 | F | F | B | B |
| 425 | 0 1 1 0 1 0 1 0 0 1 | 21 | 22 | 18 | 17 | F | F | B | B |
| 426 | 0 1 1 0 1 0 1 0 1 0 | 9 | 10 | 24 | 24 | F | F | D/C | D |
| 427 | 0 1 1 0 1 0 1 0 1 1 | 8 | 9 | 24 | 24 | F | F | D/C | D |
| 428 | 0 1 1 0 1 0 1 1 0 0 | 15 | 15 | 5 | 4 | D/E | D | B | B |
| 429 | 0 1 1 0 1 0 1 1 0 1 | 15 | 15 | 6 | 5 | D/E | D | B | B |
| 430 | 0 1 1 0 1 0 1 1 1 0 | 20 | 21 | 19 | 18 | F | F | B | B |
| 431 | 0 1 1 0 1 0 1 1 1 1 | 7 | 8 | 7 | 6 | F | F | B | B |
| 432 | 0 1 1 0 1 1 0 0 0 0 | 16 | 16 | 18 | 17 | D/E | D | B | B |
| 433 | 0 1 1 0 1 1 0 0 0 1 | 19 | 20 | 7 | 6 | F | F | B | B |
| 434 | 0 1 1 0 1 1 0 0 1 0 | 5 | 5 | 10 | 10 | D/E | D | D/C | D |
| 435 | 0 1 1 0 1 1 0 0 1 1 | 8 | 9 | 7 | 6 | F | F | B | B |
| 436 | 0 1 1 0 1 1 0 1 0 0 | 3 | 3 | 6 | 5 | D/E | D | B | B |
| 437 | 0 1 1 0 1 1 0 1 0 1 | 7 | 8 | 7 | 6 | F | F | B | B |
| 438 | 0 1 1 0 1 1 0 1 1 0 | 20 | 21 | 19 | 18 | F | F | B | B |
| 439 | 0 1 1 0 1 1 0 1 1 1 | 7 | 8 | 7 | 6 | F | F | B | B |
| 440 | 0 1 1 0 1 1 1 0 0 0 | 4 | 4 | 10 | 10 | D/E | D | D/C | D |
| 441 | 0 1 1 0 1 1 1 0 0 1 | 7 | 8 | 7 | 6 | F | F | B | B |
| 442 | 0 1 1 0 1 1 1 0 1 0 | 22 | 23 | 24 | 24 | F | F | D/C | D |
| 443 | 0 1 1 0 1 1 1 0 1 1 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 444 | 0 1 1 0 1 1 1 1 0 0 | 15 | 15 | 17 | 16 | D/E | D | B | B |
| 445 | 0 1 1 0 1 1 1 1 0 1 | 7 | 8 | 7 | 6 | F | F | B | B |
| 446 | 0 1 1 0 1 1 1 1 1 0 | 20 | 21 | 19 | 18 | F | F | B | B |
| 447 | 0 1 1 0 1 1 1 1 1 1 | 7 | 8 | 7 | 6 | F | F | B | B |
| 448 | 0 1 1 1 0 0 0 0 0 0 | 4 | 4 | 10 | 10 | D/E | D | D/C | D |
| 449 | 0 1 1 1 0 0 0 0 0 1 | 20 | 21 | 9 | 9 | F | F | D/C | D |
| 450 | 0 1 1 1 0 0 0 0 1 0 | 8 | 9 | 11 | 11 | F | F | D/C | D |
| 451 | 0 1 1 1 0 0 0 0 1 1 | 20 | 21 | 19 | 18 | D/E | D | B | B |
| 452 | 0 1 1 1 0 0 0 1 0 0 | 4 | 4 | 9 | 9 | D/E | D | D/C | D |
| 453 | 0 1 1 1 0 0 0 1 0 1 | 7 | 8 | 9 | 9 | F | F | D/C | D |
| 454 | 0 1 1 1 0 0 0 1 1 0 | 20 | 21 | 19 | 18 | F | F | B | B |
| 455 | 0 1 1 1 0 0 0 1 1 1 | 7 | 8 | 7 | 6 | F | F | B | B |
| 456 | 0 1 1 1 0 0 1 0 0 0 | 10 | 11 | 12 | 12 | F | F | D/C | D |
| 457 | 0 1 1 1 0 0 1 0 0 1 | 20 | 21 | 6 | 5 | F | F | B | B |
| 458 | 0 1 1 1 0 0 1 0 1 0 | 9 | 10 | 24 | 24 | F | F | D/C | D |
| 459 | 0 1 1 1 0 0 1 0 1 1 | 20 | 21 | 9 | 9 | F | F | D/C | D |
| 460 | 0 1 1 1 0 0 1 1 0 0 | 15 | 15 | | | D/E | D | | |
| 461 | 0 1 1 1 0 0 1 1 0 1 | 7 | 8 | 6 | 5 | F | F | B | B |
| 462 | 0 1 1 1 0 0 1 1 1 0 | 20 | 21 | 19 | 18 | F | F | B | B |
| 463 | 0 1 1 1 0 0 1 1 1 1 | 7 | 8 | 6 | 5 | F | F | B | B |
| 464 | 0 1 1 1 0 1 0 0 0 0 | 19 | 20 | 19 | 18 | F | F | B | B |
| 465 | 0 1 1 1 0 1 0 0 0 1 | 7 | 8 | 9 | 9 | F | F | D/C | D |
| 466 | 0 1 1 1 0 1 0 0 1 0 | 8 | 9 | 23 | 23 | F | F | B | B |
| 467 | 0 1 1 1 0 1 0 0 1 1 | 7 | 8 | 7 | 6 | F | F | B | B |
| 468 | 0 1 1 1 0 1 0 1 0 0 | 7 | 8 | 9 | 9 | F | F | D/C | D |
| 469 | 0 1 1 1 0 1 0 1 0 1 | 7 | 8 | 6 | 5 | F | F | B | B |
| 470 | 0 1 1 1 0 1 0 1 1 0 | 20 | 21 | 19 | 18 | F | F | B | B |
| 471 | 0 1 1 1 0 1 0 1 1 1 | 7 | 8 | 7 | 6 | F | F | B | B |
| 472 | 0 1 1 1 0 1 1 0 0 0 | 21 | 22 | 23 | 23 | F | F | D/C | D |
| 473 | 0 1 1 1 0 1 1 0 0 1 | 7 | 8 | 9 | 9 | F | F | D/C | D |
| 474 | 0 1 1 1 0 1 1 0 1 0 | 8 | 9 | 11 | 11 | F | F | D/C | D |
| 475 | 0 1 1 1 0 1 1 0 1 1 | 7 | 8 | 7 | 6 | D/E | D | B | B |
| 476 | 0 1 1 1 0 1 1 1 0 0 | 7 | 8 | 9 | 9 | F | F | D/C | D |
| 477 | 0 1 1 1 0 1 1 1 0 1 | 7 | 8 | 7 | 6 | F | F | B | B |
| 478 | 0 1 1 1 0 1 1 1 1 0 | 20 | 21 | 19 | 18 | F | F | B | B |
| 479 | 0 1 1 1 0 1 1 1 1 1 | 7 | 8 | 7 | 6 | F | F | B | B |
| 480 | 0 1 1 1 1 0 0 0 0 0 | 14 | 14 | 17 | 16 | D/E | D | B | B |
| 481 | 0 1 1 1 1 0 0 0 0 1 | 4 | 4 | 6 | 5 | D/E | D | B | B |
| 482 | 0 1 1 1 1 0 0 0 1 0 | 9 | 10 | 24 | 24 | F | F | D/C | D |
| 483 | 0 1 1 1 1 0 0 0 1 1 | 4 | 4 | 6 | 5 | D/E | D | B | B |
| 484 | 0 1 1 1 1 0 0 1 0 0 | 7 | 8 | 5 | 4 | F | F | B | B |
| 485 | 0 1 1 1 1 0 0 1 0 1 | 7 | 8 | 7 | 6 | F | F | B | B |
| 486 | 0 1 1 1 1 0 0 1 1 0 | 20 | 21 | 19 | 18 | F | F | B | B |
| 487 | 0 1 1 1 1 0 0 1 1 1 | 7 | 8 | 7 | 6 | F | F | B | B |
| 488 | 0 1 1 1 1 0 1 0 0 0 | 10 | 11 | 25 | 25 | F | F | D/C | D |
| 489 | 0 1 1 1 1 0 1 0 0 1 | 8 | 9 | 23 | 23 | F | F | D/C | D |
| 490 | 0 1 1 1 1 0 1 0 1 0 | 9 | 10 | 11 | 11 | F | F | D/C | D |
| 491 | 0 1 1 1 1 0 1 0 1 1 | 7 | 8 | 6 | 5 | F | F | B | B |
| 492 | 0 1 1 1 1 0 1 1 0 0 | 15 | 15 | 18 | 17 | D/E | D | B | B |
| 493 | 0 1 1 1 1 0 1 1 0 1 | 7 | 8 | 18 | 17 | F | F | B | B |
| 494 | 0 1 1 1 1 0 1 1 1 0 | 20 | 21 | 19 | 18 | F | F | B | B |
| 495 | 0 1 1 1 1 0 1 1 1 1 | 7 | 8 | 7 | 6 | F | F | B | B |
| 496 | 0 1 1 1 1 1 0 0 0 0 | 16 | 16 | 18 | 17 | D/E | D | B | B |
| 497 | 0 1 1 1 1 1 0 0 0 1 | 19 | 18 | 6 | 5 | F | F | B | B |
| 498 | 0 1 1 1 1 1 0 0 1 0 | 8 | 9 | 23 | 23 | F | F | D/C | D |
| 499 | 0 1 1 1 1 1 0 0 1 1 | 5 | 5 | 7 | 6 | D/E | D | B | B |
| 500 | 0 1 1 1 1 1 0 1 0 0 | 7 | 8 | 5 | 4 | F | F | B | B |
| 501 | 0 1 1 1 1 1 0 1 0 1 | 7 | 8 | 9 | 9 | F | F | D/C | D |
| 502 | 0 1 1 1 1 1 0 1 1 0 | 20 | 21 | 19 | 18 | F | F | B | B |
| 503 | 0 1 1 1 1 1 0 1 1 1 | 7 | 8 | 7 | 6 | F | F | B | B |
| 504 | 0 1 1 1 1 1 1 0 0 0 | 16 | 16 | 18 | 17 | D/E | D | B | B |
| 505 | 0 1 1 1 1 1 1 0 0 1 | 19 | 20 | 6 | 5 | F | F | B | B |
| 506 | 0 1 1 1 1 1 1 0 1 0 | 9 | 10 | 24 | 24 | F | F | D/C | D |
| 507 | 0 1 1 1 1 1 1 0 1 1 | 5 | 5 | 7 | 6 | D/E | D | B | B |
| 508 | 0 1 1 1 1 1 1 1 0 0 | 7 | 8 | 18 | 17 | F | F | B | B |
| 509 | 0 1 1 1 1 1 1 1 0 1 | 7 | 8 | 9 | 9 | F | F | D/C | D |
| 510 | 0 1 1 1 1 1 1 1 1 0 | 20 | 21 | 19 | 18 | F | F | B | B |
| 511 | 0 1 1 1 1 1 1 1 1 1 | 7 | 8 | 7 | 6 | F | F | B | B |
| 512 | 1 0 0 0 0 0 0 0 0 0 | 3 | 3 | 4 | 3 | D/E | D | B | B |
| 513 | 1 0 0 0 0 0 0 0 0 1 | 8 | 9 | 7 | 6 | F | F | B | B |
| 514 | 1 0 0 0 0 0 0 0 1 0 | 9 | 10 | 24 | 24 | F | F | D/C | D |
| 515 | 1 0 0 0 0 0 0 0 1 1 | 8 | 9 | 10 | 10 | F | F | D/C | D |
| 516 | 1 0 0 0 0 0 0 1 0 0 | 15 | 15 | 5 | 6 | D/E | D | B | B |
| 517 | 1 0 0 0 0 0 0 1 0 1 | 7 | 6 | 7 | 6 | F | F | B | B |
| 518 | 1 0 0 0 0 0 0 1 1 0 | 20 | 21 | 19 | 18 | F | F | B | B |
| 519 | 1 0 0 0 0 0 0 1 1 1 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 520 | 1000001000 | 23 | 24 | 13 | 13 | F | F | D/C | D |
| 521 | 1000001001 | 8 | 9 | 10 | 10 | F | F | D/C | D |
| 522 | 1000001010 | 9 | 10 | 24 | 24 | F | F | D/C | D |
| 523 | 1000001011 | 8 | 9 | 10 | 10 | F | F | D/C | D |
| 524 | 1000001100 | 15 | 15 | 5 | 6 | D/E | D | B | B |
| 525 | 1000001101 | 7 | 8 | 7 | 6 | F | F | B | B |
| 526 | 1000001110 | 20 | 21 | 19 | 18 | F | F | B | B |
| 527 | 1000001111 | 7 | 8 | 7 | 6 | F | F | B | B |
| 528 | 1000010000 | 8 | 9 | 8 | 7 | F | F | B | B |
| 529 | 1000010001 | 5 | 5 | 7 | 6 | D/E | D | B | B |
| 530 | 1000010010 | 21 | 22 | 23 | 23 | F | F | D/C | D |
| 531 | 1000010011 | 5 | 5 | 7 | 6 | D/E | D | B | B |
| 532 | 1000010100 | 4 | 4 | 8 | 9 | D/E | D | B | B |
| 533 | 1000010101 | 7 | 8 | 7 | 6 | F | F | B | B |
| 534 | 1000010110 | 20 | 21 | 19 | 18 | F | F | B | B |
| 535 | 1000010111 | 7 | 8 | 7 | 6 | F | F | B | B |
| 536 | 1000011000 | 20 | 21 | 23 | 23 | F | F | D/C | D |
| 537 | 1000011001 | 8 | 9 | 10 | 10 | F | F | D/C | D |
| 538 | 1000011010 | 9 | 10 | 24 | 24 | F | F | D/C | D |
| 539 | 1000011011 | 8 | 9 | 7 | 6 | F | F | B | B |
| 540 | 1000011100 | 15 | 15 | 5 | 6 | D/E | D | B | B |
| 541 | 1000011101 | 7 | 8 | 6 | 5 | F | F | B | B |
| 542 | 1000011110 | 20 | 21 | 19 | 18 | F | F | B | B |
| 543 | 1000011111 | 7 | 8 | 7 | 6 | F | F | B | B |
| 544 | 1000100000 | 2 | 2 | 5 | 4 | D/E | D | B | B |
| 545 | 1000100001 | 4 | 4 | 6 | 5 | D/E | D | B | B |
| 546 | 1000100010 | 22 | 23 | 24 | 24 | F | F | D/C | D |
| 547 | 1000100011 | 8 | 9 | 7 | 6 | F | F | B | B |
| 548 | 1000100100 | 3 | 3 | 6 | 5 | D/E | D | B | B |
| 549 | 1000100101 | 4 | 4 | 6 | 5 | D/E | D | B | B |
| 550 | 1000100110 | 20 | 21 | 19 | 18 | F | F | B | B |
| 551 | 1000100111 | 7 | 8 | 7 | 6 | F | F | B | B |
| 552 | 1000101000 | 1 | 1 | 16 | 15 | D/E | D | B | B |
| 553 | 1000101001 | 8 | 9 | 6 | 5 | F | F | B | B |
| 554 | 1000101010 | 9 | 10 | 24 | 24 | F | F | D/C | D |
| 555 | 1000101011 | 7 | 8 | 7 | 6 | F | F | B | B |
| 556 | 1000101100 | 15 | 15 | 5 | 6 | D/E | D | B | B |
| 557 | 1000101101 | 7 | 8 | 6 | 5 | F | F | B | B |
| 558 | 1000101110 | 20 | 21 | 19 | 18 | F | F | B | B |
| 559 | 1000101111 | 7 | 8 | 7 | 6 | F | F | B | B |
| 560 | 1000110000 | 16 | 16 | 19 | 18 | D/E | D | B | B |
| 561 | 1000110001 | 4 | 4 | 7 | 6 | D/E | D | B | B |
| 562 | 1000110010 | 3 | 3 | 6 | 5 | D/E | D | B | B |
| 563 | 1000110011 | 7 | 8 | 7 | 6 | F | F | B | B |
| 564 | 1000110100 | 9 | 10 | 11 | 11 | F | F | D/C | D |
| 565 | 1000110101 | 7 | 8 | 7 | 6 | F | F | B | B |
| 566 | 1000110110 | 20 | 21 | 19 | 18 | F | F | B | B |
| 567 | 1000110111 | 7 | 8 | 7 | 6 | F | F | B | B |
| 568 | 1000111000 | 16 | 16 | 18 | 17 | D/E | D | B | B |
| 569 | 1000111001 | 7 | 8 | 7 | 6 | F | F | B | B |
| 570 | 1000111010 | 16 | 16 | 18 | 17 | D/E | D | B | B |
| 571 | 1000111011 | 7 | 8 | 6 | 5 | F | F | B | B |
| 572 | 1000111100 | 23 | 23 | 24 | 24 | F | F | D/C | D |
| 573 | 1000111101 | 8 | 9 | 7 | 6 | F | F | B | B |
| 574 | 1000111110 | 20 | 21 | 19 | 18 | F | F | B | B |
| 575 | 1000111111 | 7 | 8 | 7 | 6 | F | F | B | B |
| 576 | 1001000000 | 10 | 11 | 4 | 3 | F | F | B | B |
| 577 | 1001000001 | 7 | 8 | 7 | 6 | F | F | B | B |
| 578 | 1001000010 | 22 | 23 | 24 | 24 | F | F | D/C | D |
| 579 | 1001000011 | 8 | 9 | 10 | 10 | F | F | D/C | D |
| 580 | 1001000100 | 15 | 15 | 5 | 4 | D/E | D | B | B |
| 581 | 1001000101 | 7 | 8 | 6 | 5 | F | F | B | B |
| 582 | 1001000110 | 20 | 21 | 19 | 18 | F | F | B | B |
| 583 | 1001000111 | 7 | 8 | 7 | 6 | F | F | B | B |
| 584 | 1001001000 | 23 | 24 | 13 | 13 | F | F | D/C | D |
| 585 | 1001001001 | 21 | 22 | 10 | 10 | F | F | D/C | D |
| 586 | 1001001010 | 22 | 23 | 24 | 24 | F | F | D/C | D |
| 587 | 1001001011 | 8 | 9 | 10 | 10 | F | F | D/C | D |
| 588 | 1001001100 | 15 | 15 | 17 | 16 | D/E | D | B | B |
| 589 | 1001001101 | 7 | 8 | 6 | 5 | F | F | B | B |
| 590 | 1001001110 | 20 | 21 | 19 | 18 | F | F | B | B |
| 591 | 1001001111 | 7 | 8 | 7 | 6 | F | F | B | B |
| 592 | 1001010000 | 6 | 7 | 8 | 7 | F | F | B | B |
| 593 | 1001010001 | 7 | 8 | 7 | 6 | F | F | B | B |
| 594 | 1001010010 | 22 | 23 | 24 | 24 | F | F | D/C | D |
| 595 | 1001010011 | 8 | 9 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 596 | 1001010100 | 15 | 15 | 17 | 16 | D/E | D | B | B |
| 597 | 1001010101 | 7 | 8 | 6 | 5 | F | F | B | B |
| 598 | 1001010110 | 20 | 21 | 19 | 18 | F | F | B | B |
| 599 | 1001010111 | 7 | 8 | 7 | 6 | F | F | B | B |
| 600 | 1001011000 | 21 | 22 | 23 | 23 | F | F | D/C | D |
| 601 | 1001011001 | 8 | 9 | 10 | 10 | F | F | D/C | D |
| 602 | 1001011010 | 20 | 21 | 23 | 23 | F | F | D/C | D |
| 603 | 1001011011 | 8 | 9 | 7 | 6 | F | F | B | B |
| 604 | 1001011100 | 15 | 15 | 17 | 16 | D/E | D | B | B |
| 605 | 1001011101 | 7 | 8 | 6 | 5 | F | F | B | B |
| 606 | 1001011110 | 20 | 21 | 19 | 18 | F | F | B | B |
| 607 | 1001011111 | 7 | 8 | 7 | 6 | F | F | B | B |
| 608 | 1001100000 | 1 | 1 | 16 | 15 | D/E | D | B | B |
| 609 | 1001100001 | 4 | 4 | 6 | 5 | D/E | D | B | B |
| 610 | 1001100010 | 9 | 10 | 24 | 24 | F | F | D/C | D |
| 611 | 1001100011 | 21 | 22 | 7 | 6 | F | F | B | B |
| 612 | 1001100100 | 15 | 15 | 5 | 5 | D/E | D | B | B |
| 613 | 1001100101 | 7 | 8 | 6 | 5 | F | F | B | B |
| 614 | 1001100110 | 20 | 21 | 19 | 18 | F | F | B | B |
| 615 | 1001100111 | 7 | 8 | 7 | 6 | F | F | B | B |
| 616 | 1001101000 | 1 | 1 | 13 | 13 | D/E | D | D/C | D |
| 617 | 1001101001 | 8 | 9 | 6 | 5 | F | F | B | B |
| 618 | 1001101010 | 22 | 23 | 24 | 24 | F | F | B | B |
| 619 | 1001101011 | 8 | 9 | 10 | 10 | F | F | D/C | D |
| 620 | 1001101100 | 4 | 4 | 17 | 16 | D/E | D | B | B |
| 621 | 1001101101 | 7 | 8 | 6 | 5 | F | F | B | B |
| 622 | 1001101110 | 20 | 21 | 19 | 18 | F | F | B | B |
| 623 | 1001101111 | 7 | 8 | 7 | 6 | F | F | B | B |
| 624 | 1001110000 | 16 | 16 | 18 | 17 | D/E | D | B | B |
| 625 | 1001110001 | 4 | 4 | 6 | 5 | D/E | D | B | B |
| 626 | 1001110010 | 22 | 23 | 24 | 24 | F | F | D/C | D |
| 627 | 1001110011 | 21 | 22 | 7 | 6 | F | F | B | B |
| 628 | 1001110100 | 3 | 3 | 9 | 9 | D/E | D | D/C | D |
| 629 | 1001110101 | 7 | 8 | 18 | 17 | F | F | B | B |
| 630 | 1001110110 | 20 | 21 | 19 | 18 | F | F | B | B |
| 631 | 1001110111 | 7 | 8 | 7 | 6 | F | F | B | B |
| 632 | 1001111000 | 16 | 16 | 23 | 23 | D/E | D | D/C | D |
| 633 | 1001111001 | 4 | 4 | 10 | 10 | D/E | D | D/C | D |
| 634 | 1001111010 | 9 | 10 | 11 | 11 | F | F | D/C | D |
| 635 | 1001111011 | 5 | 5 | 7 | 6 | D/E | D | B | B |
| 636 | 1001111100 | 3 | 3 | 5 | 4 | F | F | B | B |
| 637 | 1001111101 | 7 | 8 | 10 | 10 | F | F | D/C | D |
| 638 | 1001111110 | 20 | 21 | 19 | 18 | F | F | B | B |
| 639 | 1001111111 | 7 | 8 | 7 | 6 | F | F | B | B |
| 640 | 1010000000 | 9 | 10 | 12 | 12 | F | F | D/C | D |
| 641 | 1010000001 | 8 | 9 | 10 | 10 | F | F | D/C | D |
| 642 | 1010000010 | 24 | 24 | 8 | 9 | D/C | D | B | B |
| 643 | 1010000011 | 8 | 9 | 7 | 6 | F | F | B | B |
| 644 | 1010000100 | 7 | 8 | 5 | 4 | F | F | B | B |
| 645 | 1010000101 | 8 | 9 | 7 | 6 | F | F | B | B |
| 646 | 1010000110 | 20 | 21 | 19 | 18 | F | F | B | B |
| 647 | 1010000111 | 8 | 9 | 7 | 6 | F | F | B | B |
| 648 | 1010001000 | 10 | 11 | 25 | 25 | F | F | D/C | D |
| 649 | 1010001001 | 8 | 9 | 10 | 10 | F | F | D/C | D |
| 650 | 1010001010 | 9 | 10 | 24 | 24 | F | F | D/C | D |
| 651 | 1010001011 | 8 | 9 | 7 | 6 | F | F | B | B |
| 652 | 1010001100 | 15 | 15 | 17 | 16 | D/E | D | B | B |
| 653 | 1010001101 | 7 | 8 | 6 | 5 | F | F | B | B |
| 654 | 1010001110 | 20 | 21 | 19 | 18 | F | F | B | B |
| 655 | 1010001111 | 8 | 9 | 7 | 6 | F | F | B | B |
| 656 | 1010010000 | 8 | 9 | 8 | 7 | F | F | B | B |
| 657 | 1010010001 | 17 | 18 | 7 | 6 | D/E | D | B | B |
| 658 | 1010010010 | 21 | 22 | 11 | 11 | F | F | D/C | D |
| 659 | 1010010011 | 8 | 9 | 7 | 6 | F | F | B | B |
| 660 | 1010010100 | 3 | 3 | 7 | 6 | D/E | D | B | B |
| 661 | 1010010101 | 7 | 8 | 7 | 6 | F | F | B | B |
| 662 | 1010010110 | 20 | 21 | 19 | 18 | F | F | B | B |
| 663 | 1010010111 | 7 | 8 | 7 | 6 | F | F | B | B |
| 664 | 1010011000 | 21 | 22 | 23 | 23 | F | F | D/C | D |
| 665 | 1010011001 | 8 | 9 | 10 | 10 | F | F | D/C | D |
| 666 | 1010011010 | 8 | 9 | 11 | 11 | F | F | D/C | D |
| 667 | 1010011011 | 5 | 5 | 7 | 6 | D/E | D | B | B |
| 668 | 1010011100 | 7 | 8 | 5 | 5 | F | F | B | B |
| 669 | 1010011101 | 7 | 8 | 9 | 9 | F | F | D/C | D |
| 670 | 1010011110 | 20 | 21 | 19 | 18 | F | F | B | B |
| 671 | 1010011111 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 672 | 1 0 1 0 1 0 0 0 0 0 | 14 | 14 | 17 | 16 | D/E | D | B | B |
| 673 | 1 0 1 0 1 0 0 0 0 1 | 8 | 9 | 10 | 10 | F | F | D/C | D |
| 674 | 1 0 1 0 1 0 0 0 1 0 | 2 | 2 | 11 | 11 | C | C | D/C | D |
| 675 | 1 0 1 0 1 0 0 0 1 1 | 8 | 9 | 23 | 23 | F | F | D/C | D |
| 676 | 1 0 1 0 1 0 0 1 0 0 | 3 | 3 | 5 | 4 | D/E | D | B | B |
| 677 | 1 0 1 0 1 0 0 1 0 1 | 8 | 9 | 7 | 6 | F | F | B | B |
| 678 | 1 0 1 0 1 0 0 1 1 0 | 20 | 21 | 19 | 18 | F | F | B | B |
| 679 | 1 0 1 0 1 0 0 1 1 1 | 8 | 9 | 7 | 6 | F | F | B | B |
| 680 | 1 0 1 0 1 0 1 0 0 0 | 14 | 14 | 16 | 15 | D/E | D | B | B |
| 681 | 1 0 1 0 1 0 1 0 0 1 | 8 | 9 | 23 | 23 | F | F | D/C | D |
| 682 | 1 0 1 0 1 0 1 0 1 0 | 23 | 23 | 24 | 24 | F | F | D/C | D |
| 683 | 1 0 1 0 1 0 1 0 1 1 | 8 | 9 | 7 | 6 | F | D | B | B |
| 684 | 1 0 1 0 1 0 1 1 0 0 | 15 | 15 | 5 | 4 | D/E | D | B | B |
| 685 | 1 0 1 0 1 0 1 1 0 1 | 16 | 16 | 6 | 5 | D/E | D | B | B |
| 686 | 1 0 1 0 1 0 1 1 1 0 | 20 | 21 | 19 | 18 | F | F | B | B |
| 687 | 1 0 1 0 1 0 1 1 1 1 | 8 | 9 | 7 | 6 | F | F | B | B |
| 688 | 1 0 1 0 1 1 0 0 0 0 | 16 | 16 | 18 | 17 | D/E | D | B | B |
| 689 | 1 0 1 0 1 1 0 0 0 1 | 8 | 9 | 7 | 6 | F | F | B | B |
| 690 | 1 0 1 0 1 1 0 0 1 0 | 8 | 9 | 11 | 11 | F | F | D/E | D |
| 691 | 1 0 1 0 1 1 0 0 1 1 | 8 | 9 | 7 | 6 | F | F | B | B |
| 692 | 1 0 1 0 1 1 0 1 0 0 | 3 | 3 | 6 | 5 | D/E | D | B | B |
| 693 | 1 0 1 0 1 1 0 1 0 1 | 7 | 8 | 7 | 6 | F | F | B | B |
| 694 | 1 0 1 0 1 1 0 1 1 0 | 20 | 21 | 19 | 18 | F | F | B | B |
| 695 | 1 0 1 0 1 1 0 1 1 1 | 7 | 8 | 7 | 6 | F | F | B | B |
| 696 | 1 0 1 0 1 1 1 0 0 0 | 21 | 22 | 23 | 23 | F | F | D/C | D |
| 697 | 1 0 1 0 1 1 1 0 0 1 | 8 | 9 | 7 | 6 | F | F | B | B |
| 698 | 1 0 1 0 1 1 1 0 1 0 | 9 | 10 | 11 | 11 | F | F | D/C | D/C |
| 699 | 1 0 1 0 1 1 1 0 1 1 | 8 | 9 | 7 | 6 | F | F | B | B |
| 700 | 1 0 1 0 1 1 1 1 0 0 | 16 | 16 | 5 | 4 | D/E | D | B | B |
| 701 | 1 0 1 0 1 1 1 1 0 1 | 7 | 8 | 6 | 5 | F | F | B | B |
| 702 | 1 0 1 0 1 1 1 1 1 0 | 20 | 21 | 19 | 18 | F | F | B | B |
| 703 | 1 0 1 0 1 1 1 1 1 1 | 7 | 8 | 7 | 6 | F | F | B | B |
| 704 | 1 0 1 1 0 0 0 0 0 0 | 23 | 24 | 12 | 12 | F | F | D/C | D |
| 705 | 1 0 1 1 0 0 0 0 0 1 | 8 | 9 | 10 | 10 | F | F | D/C | D |
| 706 | 1 0 1 1 0 0 0 0 1 0 | 9 | 10 | 24 | 24 | F | F | D/C | D |
| 707 | 1 0 1 1 0 0 0 0 1 1 | 8 | 9 | 10 | 10 | F | F | D/C | D |
| 708 | 1 0 1 1 0 0 0 1 0 0 | 15 | 15 | 5 | 4 | D/E | D | B | B |
| 709 | 1 0 1 1 0 0 0 1 0 1 | 7 | 8 | 18 | 17 | F | F | B | B |
| 710 | 1 0 1 1 0 0 0 1 1 0 | 20 | 21 | 19 | 18 | F | F | B | B |
| 711 | 1 0 1 1 0 0 0 1 1 1 | 8 | 9 | 10 | 10 | F | F | D/C | D |
| 712 | 1 0 1 1 0 0 1 0 0 0 | 23 | 23 | 24 | 24 | F | F | D/C | D |
| 713 | 1 0 1 1 0 0 1 0 0 1 | 8 | 9 | 10 | 10 | F | F | D/C | D |
| 714 | 1 0 1 1 0 0 1 0 1 0 | 23 | 23 | 11 | 11 | F | F | D/C | D |
| 715 | 1 0 1 1 0 0 1 0 1 1 | 8 | 9 | 10 | 10 | F | F | D/C | D |
| 716 | 1 0 1 1 0 0 1 1 0 0 | 15 | 15 | 5 | 4 | D/E | D | B | B |
| 717 | 1 0 1 1 0 0 1 1 0 1 | 7 | 8 | 10 | 10 | F | F | D/C | D |
| 718 | 1 0 1 1 0 0 1 1 1 0 | 20 | 21 | 19 | 18 | F | F | B | B |
| 719 | 1 0 1 1 0 0 1 1 1 1 | 8 | 9 | 10 | 10 | F | F | D/C | D |
| 720 | 1 0 1 1 0 1 0 0 0 0 | 8 | 9 | 8 | 7 | F | F | B | B |
| 721 | 1 0 1 1 0 1 0 0 0 1 | 8 | 9 | 10 | 10 | F | F | D/C | D |
| 722 | 1 0 1 1 0 1 0 0 1 0 | 21 | 22 | 23 | 23 | F | F | D/C | D |
| 723 | 1 0 1 1 0 1 0 0 1 1 | 8 | 9 | 7 | 6 | F | F | B | B |
| 724 | 1 0 1 1 0 1 0 1 0 0 | 21 | 22 | 6 | 5 | F | F | B | B |
| 725 | 1 0 1 1 0 1 0 1 0 1 | 7 | 8 | 9 | 9 | F | F | D/C | D |
| 726 | 1 0 1 1 0 1 0 1 1 0 | 20 | 21 | 19 | 18 | F | F | B | B |
| 727 | 1 0 1 1 0 1 0 1 1 1 | 7 | 8 | 7 | 6 | F | F | B | B |
| 728 | 1 0 1 1 0 1 1 0 0 0 | 21 | 22 | 23 | 23 | F | F | D/C | D |
| 729 | 1 0 1 1 0 1 1 0 0 1 | 5 | 5 | 10 | 10 | D/E | D | D/C | D |
| 730 | 1 0 1 1 0 1 1 0 1 0 | 21 | 22 | 23 | 23 | F | F | D/C | D |
| 731 | 1 0 1 1 0 1 1 0 1 1 | 5 | 5 | 7 | 6 | D/E | D | B | B |
| 732 | 1 0 1 1 0 1 1 1 0 0 | 7 | 8 | 5 | 4 | F | F | B | B |
| 733 | 1 0 1 1 0 1 1 1 0 1 | 7 | 8 | 9 | 9 | F | F | D/C | D |
| 734 | 1 0 1 1 0 1 1 1 1 0 | 20 | 21 | 19 | 18 | F | F | B | B |
| 735 | 1 0 1 1 0 1 1 1 1 1 | 7 | 8 | 7 | 6 | F | F | B | B |
| 736 | 1 0 1 1 1 0 0 0 0 0 | 14 | 14 | 4 | 3 | D/E | D | B | B |
| 737 | 1 0 1 1 1 0 0 0 0 1 | 16 | 16 | 18 | 17 | D/E | D | B | B |
| 738 | 1 0 1 1 1 0 0 0 1 0 | 9 | 10 | 24 | 24 | F | F | D/C | D |
| 739 | 1 0 1 1 1 0 0 0 1 1 | 8 | 9 | 10 | 10 | F | F | D/C | D |
| 740 | 1 0 1 1 1 0 0 1 0 0 | 3 | 3 | 5 | 4 | D/E | D | B | B |
| 741 | 1 0 1 1 1 0 0 1 0 1 | 7 | 8 | 9 | 9 | F | F | D/C | D |
| 742 | 1 0 1 1 1 0 0 1 1 0 | 8 | 9 | 10 | 10 | F | F | D/C | D |
| 743 | 1 0 1 1 1 0 0 1 1 1 | 8 | 9 | 10 | 10 | F | F | D/C | D |
| 744 | 1 0 1 1 1 0 1 0 0 0 | 14 | 14 | 25 | 25 | D/E | D | D/C | D |
| 745 | 1 0 1 1 1 0 1 0 0 1 | 8 | 9 | 10 | 10 | F | F | D/C | D |
| 746 | 1 0 1 1 1 0 1 0 1 0 | 9 | 10 | 24 | 24 | F | F | D/C | D |
| 747 | 1 0 1 1 1 0 1 0 1 1 | 8 | 9 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 748 | 1 0 1 1 1 0 1 1 0 0 | 15 | 15 | 5 | 4 | D/E | D | B | B |
| 749 | 1 0 1 1 1 0 1 1 0 1 | 7 | 8 | 6 | 5 | F | F | B | B |
| 750 | 1 0 1 1 1 0 1 1 1 0 | 20 | 21 | 19 | 18 | F | F | B | B |
| 751 | 1 0 1 1 1 0 1 1 1 1 | 8 | 9 | 7 | 6 | F | F | B | B |
| 752 | 1 0 1 1 1 1 0 0 0 0 | 16 | 16 | 18 | 17 | D/E | D | B | B |
| 753 | 1 0 1 1 1 1 0 0 0 1 | 4 | 4 | 9 | 9 | D/E | D | D/C | D |
| 754 | 1 0 1 1 1 1 0 0 1 0 | 9 | 10 | 24 | 24 | F | F | D/C | D |
| 755 | 1 0 1 1 1 1 0 0 1 1 | 5 | 5 | 7 | 6 | D/E | D | B | B |
| 756 | 1 0 1 1 1 1 0 1 0 0 | 3 | 3 | 6 | 5 | D/E | D | B | B |
| 757 | 1 0 1 1 1 1 0 1 0 1 | 7 | 8 | 9 | 9 | F | F | D/C | D |
| 758 | 1 0 1 1 1 1 0 1 1 0 | 20 | 21 | 19 | 18 | F | F | B | B |
| 759 | 1 0 1 1 1 1 0 1 1 1 | 7 | 8 | 7 | 6 | F | F | B | B |
| 760 | 1 0 1 1 1 1 1 0 0 0 | 21 | 22 | 23 | 23 | F | F | D/C | D |
| 761 | 1 0 1 1 1 1 1 0 0 1 | 5 | 5 | 7 | 6 | D/E | D | B | B |
| 762 | 1 0 1 1 1 1 1 0 1 0 | 8 | 9 | 11 | 11 | F | F | D/C | D |
| 763 | 1 0 1 1 1 1 1 0 1 1 | 5 | 5 | 7 | 6 | D/E | D | B | B |
| 764 | 1 0 1 1 1 1 1 1 0 0 | 3 | 3 | 5 | 4 | D/E | D | B | B |
| 765 | 1 0 1 1 1 1 1 1 0 1 | 7 | 8 | 9 | 9 | D/E | D | D/C | D |
| 766 | 1 0 1 1 1 1 1 1 1 0 | 20 | 21 | 19 | 18 | F | F | B | B |
| 767 | 1 0 1 1 1 1 1 1 1 1 | 7 | 8 | 7 | 6 | F | F | B | B |
| 768 | 1 1 0 0 0 0 0 0 0 0 | 15 | 15 | 18 | 17 | D/E | D | B | B |
| 769 | 1 1 0 0 0 0 0 0 0 1 | 4 | 4 | 18 | 17 | D/E | D | B | B |
| 770 | 1 1 0 0 0 0 0 0 1 0 | 9 | 10 | 24 | 24 | F | F | D/C | D |
| 771 | 1 1 0 0 0 0 0 0 1 1 | 21 | 22 | 10 | 10 | F | F | D/C | D |
| 772 | 1 1 0 0 0 0 0 1 0 0 | 16 | 16 | 6 | 5 | D/E | D | B | B |
| 773 | 1 1 0 0 0 0 0 1 0 1 | 4 | 4 | 6 | 5 | D/E | D | B | B |
| 774 | 1 1 0 0 0 0 0 1 1 0 | 20 | 21 | 19 | 18 | F | F | B | B |
| 775 | 1 1 0 0 0 0 0 1 1 1 | 4 | 4 | 6 | 5 | D/E | D | B | B |
| 776 | 1 1 0 0 0 0 1 0 0 0 | 23 | 24 | 25 | 25 | F | F | D/C | D |
| 777 | 1 1 0 0 0 0 1 0 0 1 | 8 | 9 | 10 | 10 | F | F | D/C | D |
| 778 | 1 1 0 0 0 0 1 0 1 0 | 21 | 22 | 24 | 24 | F | F | D/C | D |
| 779 | 1 1 0 0 0 0 1 0 1 1 | 21 | 22 | 10 | 10 | F | F | D/C | D |
| 780 | 1 1 0 0 0 0 1 1 0 0 | 15 | 15 | 5 | 4 | D/E | D | B | B |
| 781 | 1 1 0 0 0 0 1 1 0 1 | 4 | 4 | 6 | 5 | D/E | D | B | B |
| 782 | 1 1 0 0 0 0 1 1 1 0 | 20 | 21 | 19 | 18 | F | F | B | B |
| 783 | 1 1 0 0 0 0 1 1 1 1 | 4 | 4 | 6 | 5 | D/E | D | B | B |
| 784 | 1 1 0 0 0 1 0 0 0 0 | 8 | 9 | 23 | 23 | F | F | D/C | D |
| 785 | 1 1 0 0 0 1 0 0 0 1 | 4 | 4 | 7 | 6 | D/E | D | B | B |
| 786 | 1 1 0 0 0 1 0 0 1 0 | 5 | 5 | 7 | 6 | D/E | D | B | B |
| 787 | 1 1 0 0 0 1 0 0 1 1 | 5 | 5 | 7 | 6 | D/E | D | B | B |
| 788 | 1 1 0 0 0 1 0 1 0 0 | 7 | 8 | 6 | 5 | F | F | B | B |
| 789 | 1 1 0 0 0 1 0 1 0 1 | 7 | 8 | 7 | 6 | F | F | B | B |
| 790 | 1 1 0 0 0 1 0 1 1 0 | 20 | 21 | 19 | 18 | F | F | B | B |
| 791 | 1 1 0 0 0 1 0 1 1 1 | 7 | 8 | 7 | 6 | F | F | B | B |
| 792 | 1 1 0 0 0 1 1 0 0 0 | 21 | 22 | 23 | 23 | F | F | D/C | D |
| 793 | 1 1 0 0 0 1 1 0 0 1 | 5 | 5 | 7 | 6 | D/E | D | B | B |
| 794 | 1 1 0 0 0 1 1 0 1 0 | 8 | 9 | 11 | 11 | F | F | D/C | D |
| 795 | 1 1 0 0 0 1 1 0 1 1 | 5 | 5 | 7 | 6 | D/E | D | B | B |
| 796 | 1 1 0 0 0 1 1 1 0 0 | 3 | 3 | 6 | 5 | D/E | D | B | B |
| 797 | 1 1 0 0 0 1 1 1 0 1 | 7 | 8 | 9 | 9 | F | F | D/C | D |
| 798 | 1 1 0 0 0 1 1 1 1 0 | 20 | 21 | 19 | 18 | F | F | B | B |
| 799 | 1 1 0 0 0 1 1 1 1 1 | 7 | 8 | 7 | 6 | F | F | B | B |
| 800 | 1 1 0 0 1 0 0 0 0 0 | 3 | 3 | 5 | 4 | D/E | D | B | B |
| 801 | 1 1 0 0 1 0 0 0 0 1 | 15 | 15 | 18 | 17 | D/E | D | B | B |
| 802 | 1 1 0 0 1 0 0 0 1 0 | 21 | 22 | 24 | 24 | F | F | D/C | D |
| 803 | 1 1 0 0 1 0 0 0 1 1 | 8 | 9 | 6 | 5 | F | F | B | B |
| 804 | 1 1 0 0 1 0 0 1 0 0 | 3 | 3 | 6 | 5 | D/E | D | B | B |
| 805 | 1 1 0 0 1 0 0 1 0 1 | 4 | 4 | 6 | 5 | D/E | D | B | B |
| 806 | 1 1 0 0 1 0 0 1 1 0 | 20 | 21 | 19 | 18 | F | F | B | B |
| 807 | 1 1 0 0 1 0 0 1 1 1 | 4 | 4 | 6 | 5 | D/E | D | B | B |
| 808 | 1 1 0 1 1 0 1 0 0 0 | 16 | 16 | 18 | 17 | D/E | D | B | B |
| 809 | 1 1 0 0 1 0 1 0 0 1 | 4 | 4 | 7 | 6 | D/E | D | B | B |
| 810 | 1 1 0 0 1 0 1 0 1 0 | 8 | 9 | 7 | 6 | F | F | B | B |
| 811 | 1 1 0 0 1 0 1 0 1 1 | 5 | 5 | 7 | 6 | D/E | D | B | B |
| 812 | 1 1 0 0 1 0 1 1 0 0 | 3 | 3 | 6 | 5 | D/E | D | B | B |
| 813 | 1 1 0 0 1 0 1 1 0 1 | 7 | 8 | 7 | 6 | F | F | B | B |
| 814 | 1 1 0 0 1 0 1 1 1 0 | 20 | 21 | 19 | 18 | F | F | B | B |
| 815 | 1 1 0 0 1 0 1 1 1 1 | 4 | 4 | 6 | 5 | D/E | D | B | B |
| 816 | 1 1 0 0 1 1 0 0 0 0 | 16 | 16 | 18 | 17 | D/E | D | B | B |
| 817 | 1 1 0 0 1 1 0 0 0 1 | 4 | 4 | 7 | 6 | D/E | D | B | B |
| 818 | 1 1 0 0 1 1 0 0 1 0 | 8 | 9 | 7 | 6 | F | F | B | B |
| 819 | 1 1 0 0 1 1 0 0 1 1 | 5 | 5 | 7 | 6 | D/E | D | B | B |
| 820 | 1 1 0 0 1 1 0 1 0 0 | 3 | 3 | 6 | 5 | D/E | D | B | B |
| 821 | 1 1 0 0 1 1 0 1 0 1 | 4 | 4 | 7 | 6 | D/E | D | B | B |
| 822 | 1 1 0 0 1 1 0 1 1 0 | 20 | 21 | 19 | 18 | F | F | B | B |
| 823 | 1 1 0 0 1 1 0 1 1 1 | 7 | 8 | 7 | 6 | F | F | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 824 | 1 1 0 0 1 1 1 0 0 0 | 16 | 16 | 18 | 17 | D/E | D | B | B |
| 825 | 1 1 0 0 1 1 1 0 0 1 | 4 | 4 | 7 | 6 | D/E | D | B | B |
| 826 | 1 1 0 0 1 1 1 0 1 0 | 8 | 9 | 11 | 11 | F | F | D/C | D |
| 827 | 1 1 0 0 1 1 1 0 1 1 | 4 | 4 | 7 | 6 | D/E | D | B | B |
| 828 | 1 1 0 0 1 1 1 1 0 0 | 3 | 3 | 6 | 5 | D/E | D | B | B |
| 829 | 1 1 0 0 1 1 1 1 0 1 | 7 | 8 | 6 | 5 | F | F | B | B |
| 830 | 1 1 0 0 1 1 1 1 1 0 | 20 | 21 | 19 | 18 | F | F | B | B |
| 831 | 1 1 0 0 1 1 1 1 1 1 | 7 | 8 | 7 | 6 | F | F | B | B |
| 832 | 1 1 0 1 0 0 0 0 0 0 | 2 | 2 | 18 | 17 | D/E | D | B | B |
| 833 | 1 1 0 1 0 0 0 0 0 1 | 4 | 4 | 6 | 5 | D/E | D | B | B |
| 834 | 1 1 0 1 0 0 0 0 1 0 | 9 | 10 | 24 | 24 | F | F | D/C | D |
| 835 | 1 1 0 1 0 0 0 0 1 1 | 21 | 22 | 7 | 6 | D/E | D | B | B |
| 836 | 1 1 0 1 0 0 0 1 0 0 | 15 | 15 | 5 | 4 | D/E | D | B | B |
| 837 | 1 1 0 1 0 0 0 1 0 1 | 4 | 4 | 6 | 5 | D/E | D | B | B |
| 838 | 1 1 0 1 0 0 0 1 1 0 | 20 | 21 | 19 | 18 | F | F | B | B |
| 839 | 1 1 0 1 0 0 0 1 1 1 | 4 | 4 | 6 | 5 | D/E | D | B | B |
| 840 | 1 1 0 1 0 0 1 0 0 0 | 10 | 11 | 25 | 25 | F | F | D/C | D |
| 841 | 1 1 0 1 0 0 1 0 0 1 | 21 | 22 | 23 | 23 | F | F | D/C | D |
| 842 | 1 1 0 1 0 0 1 0 1 0 | 9 | 10 | 11 | 11 | F | F | D/C | D |
| 843 | 1 1 0 1 0 0 1 0 1 1 | 5 | 5 | 7 | 6 | D/E | D | B | B |
| 844 | 1 1 0 1 0 0 1 1 0 0 | 15 | 15 | 5 | 4 | D/E | D | B | B |
| 845 | 1 1 0 1 0 0 1 1 0 1 | 4 | 4 | 6 | 5 | D/E | D | B | B |
| 846 | 1 1 0 1 0 0 1 1 1 0 | 20 | 21 | 19 | 18 | F | F | B | B |
| 847 | 1 1 0 1 0 0 1 1 1 1 | 4 | 4 | 6 | 5 | D/E | D | B | B |
| 848 | 1 1 0 1 0 1 0 0 0 0 | 6 | 7 | 6 | 5 | F | F | B | B |
| 849 | 1 1 0 1 0 1 0 0 0 1 | 4 | 4 | 6 | 5 | D/E | D | B | B |
| 850 | 1 1 0 1 0 1 0 0 1 0 | 18 | 17 | 8 | 9 | F | F | B | B |
| 851 | 1 1 0 1 0 1 0 0 1 1 | 5 | 5 | 7 | 6 | D/E | D | B | B |
| 852 | 1 1 0 1 0 1 0 1 0 0 | 16 | 16 | 18 | 17 | D/E | D | B | B |
| 853 | 1 1 0 1 0 1 0 1 0 1 | 7 | 8 | 6 | 5 | F | F | B | B |
| 854 | 1 1 0 1 0 1 0 1 1 0 | 20 | 21 | 19 | 18 | F | F | B | B |
| 855 | 1 1 0 1 0 1 0 1 1 1 | 7 | 8 | 7 | 6 | F | F | B | B |
| 856 | 1 1 0 1 0 1 1 0 0 0 | 21 | 22 | 23 | 23 | F | F | D/C | D |
| 857 | 1 1 0 1 0 1 1 0 0 1 | 5 | 5 | 10 | 10 | D/E | D | D/C | D |
| 858 | 1 1 0 1 0 1 1 0 1 0 | 8 | 9 | 11 | 11 | F | F | D/C | D |
| 859 | 1 1 0 1 0 1 1 0 1 1 | 5 | 5 | 7 | 6 | D/E | D | B | B |
| 860 | 1 1 0 1 0 1 1 1 0 0 | 15 | 15 | 5 | 4 | D/E | D | B | B |
| 861 | 1 1 0 1 0 1 1 1 0 1 | 7 | 8 | 9 | 9 | F | F | D/C | D |
| 862 | 1 1 0 1 0 1 1 1 1 0 | 20 | 21 | 19 | 18 | F | F | B | B |
| 863 | 1 1 0 1 0 1 1 1 1 1 | 7 | 8 | 7 | 6 | F | F | B | B |
| 864 | 1 1 0 1 1 0 0 0 0 0 | 15 | 15 | 17 | 16 | D/E | D | B | B |
| 865 | 1 1 0 1 1 0 0 0 0 1 | 4 | 4 | 6 | 5 | D/E | D | B | B |
| 866 | 1 1 0 1 1 0 0 0 1 0 | 9 | 10 | 24 | 24 | F | F | D/C | D |
| 867 | 1 1 0 1 1 0 0 0 1 1 | 4 | 4 | 7 | 6 | D/E | D | B | B |
| 868 | 1 1 0 1 1 0 0 1 0 0 | 3 | 3 | 17 | 16 | D/E | D | B | B |
| 869 | 1 1 0 1 1 0 0 1 0 1 | 4 | 4 | 6 | 5 | D/E | D | B | B |
| 870 | 1 1 0 1 1 0 0 1 1 0 | 20 | 21 | 19 | 18 | F | F | B | B |
| 871 | 1 1 0 1 1 0 1 1 1 1 | 4 | 4 | 6 | 5 | F | F | B | B |
| 872 | 1 1 0 1 1 0 1 0 0 0 | 14 | 14 | 25 | 25 | D/E | D | D/C | D |
| 873 | 1 1 0 1 1 0 1 0 0 1 | 4 | 4 | 6 | 5 | D/E | D | B | B |
| 874 | 1 1 0 1 1 0 1 0 1 0 | 9 | 10 | 24 | 24 | F | F | D/C | D |
| 875 | 1 1 0 1 1 0 1 0 1 1 | 8 | 9 | 7 | 6 | F | F | B | B |
| 876 | 1 1 0 1 1 0 1 1 0 0 | 15 | 15 | 5 | 4 | D/E | D | B | B |
| 877 | 1 1 0 1 1 0 1 1 0 1 | 7 | 8 | 6 | 5 | F | F | B | B |
| 878 | 1 1 0 1 1 0 1 1 1 0 | 20 | 21 | 19 | 18 | F | F | B | B |
| 879 | 1 1 0 1 1 0 1 1 1 1 | 7 | 8 | 6 | 5 | F | F | B | B |
| 880 | 1 1 0 1 1 1 0 0 0 0 | 16 | 16 | 18 | 17 | D/E | D | B | B |
| 881 | 1 1 0 1 1 1 0 0 0 1 | 4 | 4 | 9 | 9 | D/E | D | B | B |
| 882 | 1 1 0 1 1 1 0 0 1 0 | 9 | 10 | 7 | 6 | F | F | B | B |
| 883 | 1 1 0 1 1 1 0 0 1 1 | 5 | 5 | 7 | 6 | D/E | D | B | B |
| 884 | 1 1 0 1 1 1 0 1 0 0 | 16 | 16 | 18 | 17 | D/E | D | B | B |
| 885 | 1 1 0 1 1 1 0 1 0 1 | 7 | 8 | 9 | 9 | F | F | D/C | D |
| 886 | 1 1 0 1 1 1 0 1 1 0 | 20 | 21 | 19 | 18 | F | F | B | B |
| 887 | 1 1 0 1 1 1 0 1 1 1 | 7 | 8 | 7 | 6 | F | F | B | B |
| 888 | 1 1 0 1 1 1 1 0 0 0 | 16 | 16 | 18 | 17 | D/E | D | B | B |
| 889 | 1 1 0 1 1 1 1 0 0 1 | 7 | 8 | 9 | 9 | F | F | D/C | D |
| 890 | 1 1 0 1 1 1 1 0 1 0 | 9 | 10 | 11 | 11 | F | F | D/C | D |
| 891 | 1 1 0 1 1 1 1 0 1 1 | 5 | 5 | 7 | 6 | D/E | D | B | B |
| 892 | 1 1 0 1 1 1 1 1 0 0 | 3 | 3 | 6 | 5 | D/E | D | B | B |
| 893 | 1 1 0 1 1 1 1 1 0 1 | 7 | 8 | 9 | 9 | F | F | D/C | D |
| 894 | 1 1 0 1 1 1 1 1 1 0 | 20 | 21 | 19 | 18 | F | F | B | B |
| 895 | 1 1 0 1 1 1 1 1 1 1 | 7 | 8 | 7 | 6 | F | F | B | B |
| 896 | 1 1 1 0 0 0 0 0 0 0 | 2 | 2 | 7 | 6 | D/E | D | B | B |
| 897 | 1 1 1 0 0 0 0 0 0 1 | 5 | 5 | 19 | 18 | D/E | D | B | B |
| 898 | 1 1 1 0 0 0 0 0 1 0 | 5 | 5 | 10 | 10 | D/E | D | D/C | D |
| 899 | 1 1 1 0 0 0 0 0 1 1 | 5 | 5 | 7 | 6 | D/E | D | B | B |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 900 | 1 1 1 0 0 0 0 1 0 0 | 3 | 3 | 6 | 5 | D/E | D | B | B |
| 901 | 1 1 1 0 0 0 0 1 0 1 | 20 | 21 | 19 | 18 | F | F | B | B |
| 902 | 1 1 1 0 0 0 0 1 1 0 | 20 | 21 | 19 | 18 | F | F | B | B |
| 903 | 1 1 1 0 0 0 0 1 1 1 | 7 | 8 | 7 | 6 | F | F | B | B |
| 904 | 1 1 1 0 0 0 1 0 0 0 | 22 | 23 | 25 | 25 | F | F | D/C | D |
| 905 | 1 1 1 0 0 0 1 0 0 1 | 8 | 9 | 10 | 10 | F | F | D/C | D |
| 906 | 1 1 1 0 0 0 1 0 1 0 | 9 | 10 | 7 | 6 | F | F | B | B |
| 907 | 1 1 1 0 0 0 1 0 1 1 | 7 | 8 | 7 | 6 | F | F | B | B |
| 908 | 1 1 1 0 0 0 1 1 0 0 | 15 | 15 | 5 | 4 | D/E | D | B | B |
| 909 | 1 1 1 0 0 0 1 1 0 1 | 8 | 9 | 10 | 10 | F | F | D/E | D |
| 910 | 1 1 1 0 0 0 1 1 1 0 | 20 | 21 | 19 | 18 | F | F | B | B |
| 911 | 1 1 1 0 0 0 1 1 1 1 | 7 | 8 | 7 | 6 | F | F | B | B |
| 912 | 1 1 1 0 0 1 0 0 0 0 | 20 | 21 | 20 | 19 | F | F | B | B |
| 913 | 1 1 1 0 0 1 0 0 0 1 | 5 | 5 | 7 | 6 | D/E | D | B | B |
| 914 | 1 1 1 0 0 1 0 0 1 0 | 5 | 5 | 7 | 6 | D/E | D | B | B |
| 915 | 1 1 1 0 0 1 0 0 1 1 | 8 | 9 | 7 | 6 | F | F | B | B |
| 916 | 1 1 1 0 0 1 0 1 0 0 | 16 | 16 | 6 | 5 | D/E | D | B | B |
| 917 | 1 1 1 0 0 1 0 1 0 1 | 7 | 8 | 7 | 6 | F | F | B | B |
| 918 | 1 1 1 0 0 1 0 1 1 0 | 20 | 21 | 19 | 18 | F | F | B | B |
| 919 | 1 1 1 0 0 1 0 1 1 1 | 7 | 8 | 7 | 6 | F | F | B | B |
| 920 | 1 1 1 0 0 1 1 0 0 0 | 21 | 22 | 23 | 23 | F | F | D/E | D |
| 921 | 1 1 1 0 0 1 1 0 0 1 | 8 | 9 | 20 | 21 | F | F | B | B |
| 922 | 1 1 1 0 0 1 1 0 1 0 | 9 | 10 | 7 | 6 | F | F | B | B |
| 923 | 1 1 1 0 0 1 1 0 1 1 | 5 | 5 | 7 | 6 | D/E | D | B | B |
| 924 | 1 1 1 0 0 1 1 1 0 0 | 16 | 16 | 6 | 5 | D/E | D | B | B |
| 925 | 1 1 1 0 0 1 1 1 0 1 | 7 | 8 | 9 | 9 | F | F | D/C | D |
| 926 | 1 1 1 0 0 1 1 1 1 0 | 20 | 21 | 19 | 18 | F | F | B | B |
| 927 | 1 1 1 0 0 1 1 1 1 1 | 7 | 8 | 7 | 6 | F | F | B | B |
| 928 | 1 1 1 0 1 0 0 0 0 0 | 2 | 2 | 4 | 3 | D/E | D | B | B |
| 929 | 1 1 1 0 1 0 0 0 0 1 | 8 | 9 | 19 | 18 | F | F | B | B |
| 930 | 1 1 1 0 1 0 0 0 1 0 | 9 | 10 | 24 | 24 | F | F | D/C | D |
| 931 | 1 1 1 0 1 0 0 0 1 1 | 8 | 9 | 7 | 6 | F | F | B | B |
| 932 | 1 1 1 0 1 0 0 1 0 0 | 15 | 15 | 5 | 4 | D/E | D | B | B |
| 933 | 1 1 1 0 1 0 0 1 0 1 | 5 | 5 | 19 | 18 | D/E | D | B | B |
| 934 | 1 1 1 0 1 0 0 1 1 0 | 20 | 21 | 19 | 18 | F | F | B | B |
| 935 | 1 1 1 0 1 0 0 1 1 1 | 8 | 9 | 7 | 6 | F | F | B | B |
| 936 | 1 1 1 0 1 0 1 0 0 0 | 14 | 14 | 4 | 3 | D/E | D | B | B |
| 937 | 1 1 1 0 1 0 1 0 0 1 | 16 | 16 | 6 | 5 | D/E | D | B | B |
| 938 | 1 1 1 0 1 0 1 0 1 0 | 21 | 22 | 24 | 24 | F | F | D/C | D |
| 939 | 1 1 1 0 1 0 1 0 1 1 | 21 | 22 | 7 | 6 | F | F | B | B |
| 940 | 1 1 1 0 1 0 1 1 0 0 | 3 | 3 | 5 | 4 | D/E | D | B | B |
| 941 | 1 1 1 0 1 0 1 1 0 1 | 8 | 9 | 7 | 6 | F | F | B | B |
| 942 | 1 1 1 0 1 0 1 1 1 0 | 20 | 21 | 19 | 18 | F | F | B | B |
| 943 | 1 1 1 0 1 0 1 1 1 1 | 7 | 8 | 7 | 6 | F | F | B | B |
| 944 | 1 1 1 0 1 1 0 0 0 0 | 16 | 16 | 18 | 17 | D/E | D | B | B |
| 945 | 1 1 1 0 1 1 0 0 0 1 | 5 | 5 | 7 | 6 | D/E | D | B | B |
| 946 | 1 1 1 0 1 1 0 0 1 0 | 5 | 5 | 7 | 6 | D/E | D | B | B |
| 947 | 1 1 1 0 1 1 0 0 1 1 | 7 | 8 | 7 | 6 | D/E | D | B | B |
| 948 | 1 1 1 0 1 1 0 1 0 0 | 3 | 3 | 6 | 5 | D/E | D | B | B |
| 949 | 1 1 1 0 1 1 0 1 0 1 | 7 | 8 | 7 | 6 | F | F | B | B |
| 950 | 1 1 1 0 1 1 0 1 1 0 | 20 | 21 | 19 | 18 | F | F | B | B |
| 951 | 1 1 1 0 1 1 0 1 1 1 | 7 | 8 | 7 | 6 | F | F | B | B |
| 952 | 1 1 1 0 1 1 1 0 0 0 | 21 | 22 | 23 | 23 | F | F | D/C | D |
| 953 | 1 1 1 0 1 1 1 0 0 1 | 8 | 9 | 19 | 20 | F | F | B | B |
| 954 | 1 1 1 0 1 1 1 0 1 0 | 21 | 22 | 7 | 6 | F | F | B | B |
| 955 | 1 1 1 0 1 1 1 0 1 1 | 5 | 5 | 7 | 6 | D/E | D | B | B |
| 956 | 1 1 1 0 1 1 1 1 0 0 | 15 | 15 | 5 | 4 | D/E | D | B | B |
| 957 | 1 1 1 0 1 1 1 1 0 1 | 7 | 8 | 9 | 9 | F | F | D/C | D |
| 958 | 1 1 1 0 1 1 1 1 1 0 | 20 | 21 | 19 | 18 | F | F | B | B |
| 959 | 1 1 1 0 1 1 1 1 1 1 | 7 | 8 | 7 | 6 | F | F | B | B |
| 960 | 1 1 1 1 0 0 0 0 0 0 | 7 | 8 | 7 | 6 | F | F | B | B |
| 961 | 1 1 1 1 0 0 0 0 0 1 | | | | | | | | |
| 962 | 1 1 1 1 0 0 0 0 1 0 | | | | | | | | |
| 963 | 1 1 1 1 0 0 0 0 1 1 | | | | | | | | |
| 964 | 1 1 1 1 0 0 0 1 0 0 | | | | | | | | |
| 965 | 1 1 1 1 0 0 0 1 0 1 | | | | | | | | |
| 966 | 1 1 1 1 0 0 0 1 1 0 | | | | | | | | |
| 967 | 1 1 1 1 0 0 0 1 1 1 | | | | | | | | |
| 968 | 1 1 1 1 0 0 1 0 0 0 | | | | | | | | |
| 969 | 1 1 1 1 0 0 1 0 0 1 | | | | | | | | |
| 970 | 1 1 1 1 0 0 1 0 1 0 | | | | | | | | |
| 971 | 1 1 1 1 0 0 1 0 1 1 | | | | | | | | |
| 972 | 1 1 1 1 0 0 1 1 0 0 | | | | | | | | |
| 973 | 1 1 1 1 0 0 1 1 0 1 | | | | | | | | |
| 974 | 1 1 1 1 0 0 1 1 1 0 | | | | | | | | |
| 975 | 1 1 1 1 0 0 1 1 1 1 | | | | | | | | |

TRUTH TABLE-continued

| Reference Number | 1 = Pin(s) Standing 0 = Pin(s) Down Pin Numbers(s) 10 9 8 7 6 5 4 3 2 1 | Select Foot Lights For Each Condition Foot Lights 1-25 Right Hand Hook | Right Hand St. | Left Hand Hook | Left Hand St. | Select Arrow Lights For Each Condition Arrow Lights A-G Right Hand Hook | Right Hand St. | Left Hand Hook | Left Hand St. |
|---|---|---|---|---|---|---|---|---|---|
| 976 | 1 1 1 1 0 1 0 0 0 0 | ILLEGAL COMBINATIONS PINS CONNOT BE LEFT STANDING | | | | | | | |
| 977 | 1 1 1 1 0 1 0 0 0 1 | | | | | | | | |
| 978 | 1 1 1 1 0 1 0 0 1 0 | | | | | | | | |
| 979 | 1 1 1 1 0 1 0 0 1 1 | | | | | | | | |
| 980 | 1 1 1 1 0 1 0 1 0 0 | | | | | | | | |
| 981 | 1 1 1 1 0 1 0 1 0 1 | | | | | | | | |
| 982 | 1 1 1 1 0 1 0 1 1 0 | | | | | | | | |
| 983 | 1 1 1 1 0 1 0 1 1 1 | | | | | | | | |
| 984 | 1 1 1 1 0 1 1 0 0 0 | | | | | | | | |
| 985 | 1 1 1 1 0 1 1 0 0 1 | | | | | | | | |
| 986 | 1 1 1 1 0 1 1 0 1 0 | | | | | | | | |
| 987 | 1 1 1 1 0 1 1 0 1 1 | | | | | | | | |
| 988 | 1 1 1 1 0 1 1 1 0 0 | | | | | | | | |
| 989 | 1 1 1 1 0 1 1 1 0 1 | | | | | | | | |
| 990 | 1 1 1 1 0 1 1 1 1 0 | | | | | | | | |
| 991 | 1 1 1 1 0 1 1 1 1 1 | | | | | | | | |
| 992 | 1 1 1 1 1 0 0 0 0 0 | | | | | | | | |
| 993 | 1 1 1 1 1 0 0 0 0 1 | | | | | | | | |
| 994 | 1 1 1 1 1 0 0 0 1 0 | | | | | | | | |
| 995 | 1 1 1 1 1 0 0 0 1 1 | | | | | | | | |
| 996 | 1 1 1 1 1 0 0 1 0 0 | | | | | | | | |
| 997 | 1 1 1 1 1 0 0 1 0 1 | | | | | | | | |
| 998 | 1 1 1 1 1 0 0 1 1 0 | | | | | | | | |
| 999 | 1 1 1 1 1 0 0 1 1 1 | | | | | | | | |
| 1000 | 1 1 1 1 1 0 1 0 0 0 | | | | | | | | |
| 1001 | 1 1 1 1 1 0 1 0 0 1 | 7 | 8 | 7 | 6 | F | F | B | B |
| 1002 | 1 1 1 1 1 0 1 0 1 0 | | | | | | | | |
| 1003 | 1 1 1 1 1 0 1 0 1 1 | | | | | | | | |
| 1004 | 1 1 1 1 1 0 1 1 0 0 | | | | | | | | |
| 1005 | 1 1 1 1 1 0 1 1 0 1 | | | | | | | | |
| 1006 | 1 1 1 1 1 0 1 1 1 0 | | | | | | | | |
| 1007 | 1 1 1 1 1 0 1 1 1 1 | | | | | | | | |
| 1008 | 1 1 1 1 1 1 0 0 0 0 | | | | | | | | |
| 1009 | 1 1 1 1 1 1 0 0 0 1 | | | | | | | | |
| 1010 | 1 1 1 1 1 1 0 0 1 0 | | | | | | | | |
| 1011 | 1 1 1 1 1 1 0 0 1 1 | | | | | | | | |
| 1012 | 1 1 1 1 1 1 0 1 0 0 | ILLEGAL COMBINATIONS PINS CANNOT BE LEFT STANDING | | | | | | | |
| 1013 | 1 1 1 1 1 1 0 1 0 1 | | | | | | | | |
| 1014 | 1 1 1 1 1 1 0 1 1 0 | | | | | | | | |
| 1015 | 1 1 1 1 1 1 0 1 1 1 | | | | | | | | |
| 1016 | 1 1 1 1 1 1 1 0 0 0 | | | | | | | | |
| 1017 | 1 1 1 1 1 1 1 0 0 1 | | | | | | | | |
| 1018 | 1 1 1 1 1 1 1 0 1 0 | | | | | | | | |
| 1019 | 1 1 1 1 1 1 1 0 1 1 | | | | | | | | |
| 1020 | 1 1 1 1 1 1 1 1 0 0 | | | | | | | | |
| 1021 | 1 1 1 1 1 1 1 1 0 1 | | | | | | | | |
| 1022 | 1 1 1 1 1 1 1 1 1 0 | | | | | | | | |
| 1023 | 1 1 1 1 1 1 1 1 1 1 | | | | | | | | |

While the invention has been described in its preferred embodiments it is to be understood that the words which have been used are words of description rather than limitation and that changes may be made within the purview of the appended claims without departing from the true scope and spirit of the invention in its broader aspects.

What is claimed:

1. An automatic bowling position indicator for a bowling lane comprising:

means for indicating the position of bowling pins on the lane;

means for entering bowling characteristics of at least one bowler, the bowling characteristics for each bowler including the throwing hand of the bowler and whether the bowler bowls a straight or hook ball;

processing means, responsive to said pin position indicating means and said characteristic entering means, for determining a foot position for an individual bowler and for determining a place on the lane over which a bowling ball should pass, in response to the bowling characteristics entered;

first lighting means positioned on the surface of said bowling lane for automatically indicating the foot position of the individual bowler, said first lighting means including two rows of lights disposed behind a foul line of said bowling lane; and second lighting means positioned on the surface of said bowling lane for automatically indicating the place over which the bowling ball should pass, said second lighting means including a plurality of lights disposed forward of said first lighting means.

2. An apparatus according to claim 1 wherein said processing means is capable of automatically sequencing through a plurality of bowlers having particular bowling characteristics.

3. An apparatus according to claim 2 wherein said entering means includes a keyboard and a plurality of lights for displaying the bowling characteristics of the bowlers.

4. An apparatus according to claim 3 which further includes a digital display for identifying an individual bowler.

5. An apparatus according to claim 4 wherein said processing means includes mixing means for selecting lights to be lighted in said first and second lighting means, said mixing means including memory means for storing data indicative of the lights to be lighted.

6. An apparatus according to claim 5 wherein the lights in said first lighting means include a semi-circular shape.

7. An apparatus according to claim 6 wherein the lights in said second lighting means include an arrow shape.

* * * * *